United States Patent [19]

Aono et al.

[11] Patent Number: 4,952,479

[45] Date of Patent: Aug. 28, 1990

[54] DRY IMAGE FORMING PROCESS AND MATERIAL THEREFORE

[75] Inventors: Toshiaki Aono; Koichi Nakamura, both of Kanagawa, Japan

[73] Assignee: Fuji Photo Film Co., Ltd., Kanagawa, Japan

[21] Appl. No.: 876,665

[22] Filed: Jun. 20, 1986

Related U.S. Application Data

[63] Continuation of Ser. No. 592,195, Mar. 22, 1984, abandoned.

[30] Foreign Application Priority Data

| | | | |
|---|---|---|---|
| Mar. 25, 1983 | [JP] | Japan | 58-48750 |
| Mar. 25, 1983 | [JP] | Japan | 58-48751 |
| Mar. 25, 1983 | [JP] | Japan | 58-48752 |
| Mar. 31, 1983 | [JP] | Japan | 58-56422 |

[51] Int. Cl.[5] ..... G03C 5/54

[52] U.S. Cl. ..... 430/203; 430/617; 430/619

[58] Field of Search ..... 430/203, 223, 617, 619, 430/351, 218

[56] References Cited

U.S. PATENT DOCUMENTS

| | | | |
|---|---|---|---|
| 4,124,387 | 11/1978 | Kohrt | 430/203 |
| 4,390,617 | 6/1983 | Okaniwa et al. | 430/350 |
| 4,430,415 | 2/1984 | Aono et al. | 430/203 |
| 4,500,624 | 2/1985 | Aono et al. | 430/203 |
| 4,500,626 | 2/1985 | Naito et al.l | 430/203 |
| 4,504,568 | 3/1985 | Clark et al. | 430/203 |

FOREIGN PATENT DOCUMENTS

| | | | |
|---|---|---|---|
| 0066282 | 12/1982 | European Pat. Off. | 430/203 |
| 0076492 | 4/1983 | European Pat. Off. | 430/203 |
| 1463243 | 12/1966 | France . | |
| 2058383 | 4/1981 | United Kingdom | 430/203 |
| 2100458 | 12/1982 | United Kingdom | 430/203 |

OTHER PUBLICATIONS

Humphlett et al., "Aldonamides . . . image-forming compositions", *Research Disclosure No.* 12021, 4/1974, pp. 14–16.

Research Disclosure No. 150, Oct. 1976, p. 22, Disclosure No. 15027, LaRosa et al., "Melt formers in Photothermographic Materials".

Research Disclosure No. 194, Jun. 1980, pp. 264–268, Disclosure No. 19,419, "Heat-Developable Material and Process".

*Primary Examiner*—Richard L. Schilling

*Attorney, Agent, or Firm*—Sughrue, Mion, Zinn, Macpeak & Seas

[57] ABSTRACT

A process which comprises transferring a dye imagewise formed on a silver halide light-sensitive material comprising a support having thereon a light-sensitive silver halide, a binder and a mobile dye-forming compound which forms a dye in a chemical relation of the compound upon a reduction reaction of the silver halide to silver by a heat development of the light-sensitive material after or simultaneously with an image exposure, into a dye fixing layer in the presence of a thermal solvent at a high-temperature at which the thermal solvent is in a molten state. The process can be conducted without supplying solvent from the outside.

14 Claims, No Drawings

DRY IMAGE FORMING PROCESS AND MATERIAL THEREFORE

This is a continuation of application Ser. No. 592,195 filed Mar. 22, 1984, now abandoned.

FIELD OF THE INVENTION

This invention relates to a complete dry image-forming process using a silver halide light-sensitive material. More particularly, the invention relates to a process of fixing dyes obtained in a silver halide light-sensitive material by heat development to a dye-fixing layer by heating without supplying any solvent from the outside.

BACKGROUND OF THE INVENTION

Since a photographic process using silver halide is excellent in photographic characteristics such as sensitivity, gradation control, etc., as compared to other photographic processes such as an electrophotogrpahic process and a diazo photographic process, the silver halide photographic process has been most widely used. Recently, however, a technique capable of easily and quickly obtaining images has been developed by performing the image formation of a light-sensitive material using silver halide by a dry treatment such as heating in place of performing the image-formation by a conventional wet treatment such as a treatment by a developing liquid, etc.

A heat developable light-sensitive material is known in the field of the art and such a heat developable light-sensitive material and a process of processing it are described in, for example, *Shashin Kogaku no Kiso* (*The Basis of Photographic Engineering*), pages 553–555, published by Korona K. K. in 1979; *EIZO JOHO* (*Image Information*), page 40, published in Apr. 1978; *Nebletts Handbook of Photography and Reprography*, 7th Ed., pages 32–33, published by Van Nostrand Reinhold Company; U.S. Pat. Nos. 3,152,904; 3,301,678; 3,392,020 and 3,457,075; U.K. Patent Nos. 1,131,108 and 1,167,777; and *Research Disclosure*, pages 9–15 Jun. 1978 (RD-17029).

Various processes of obtaining color images by a dry system have been proposed. For example, for a process of forming color images by the combination of the oxidation product of a developing agent and couplers, a reducing agent such as p-phenylenediamines and phenolic or active methylene couplers are disclosed in U.S. Pat. No. 3,531,286, p-aminophenolic reducing agents are disclosed in U.S. Pat. No. 3,761,270, sulfonamidophenolic reducing agents are disclosed in Belgian Patent No. 802,519 and *Research Disclosure*, pages 31–32, Sept. 1975, and the combination of the sulfonamidophenolic reducing agents and four-equilvalent couplers is disclosed in U.S. Pat. No. 4,021,240.

However, the foregoing processes have a fault that color images formed become turbid since an image of reduced image and a color image are simultaneously formed at the exposed area of a light-sensitive material after heat development. For overcoming the fault, there is a method of removing the silver image by a liquid treatment or a method of transferring the dye only to other layer such as a sheet having an image-receiving layer. However, such a method has also a fault that it is not easy to transfer the dye only separately from unreacted materials.

Also, a method of introducing a nitrogen-containing heterocyclic group in a dye, forming a silver salt, and liberating the dye by heat development is described in *Research Disclosure*, pages 54–58, May 1978 (RD-16966). However, the method cannot form clear images since it is difficult to liberate the dye at unexposed areas and hence is not suitable for general use.

Furthermore, useful dyes and bleaching processes for forming positive dye images by a heat-sensitive silver dye bleach process are described in, for example, *Research Disclosure*, pages 30–32, Apr. 1976 (RD-14433); ibid, pages 14–15, Dec. 1976 (RD-15227); U.S. Pat. No. 4,235,957, etc. However, these methods have faults that additional material and step, such as an activator sheet for accelerating the bleach of the dye and a step of superposing the activator sheet and heating are required and also the color images formed by the methods cannot be stably preserved for a long period of time since the color images are gradually bleached by reduction with free silver, etc., which are co-existing.

Also, a method of forming color images utilizing leuco dyes is described in, for example, U.S. Pat. Nos. 3,985,565 and 4,022,617. However, the method has also a fault that it is difficult to stably incorporate a leuco dye in a photographic material and hence the photographic material is gradually colored during the preservation thereof.

The inventors previously proposed a novel light-sensitive material capable of overcoming the foregoing faults in the conventional methods and an image-forming process for the light-sensitive material (Japanese Patent Application No. 157,798/'81). In the foregoing image-forming process, a light-sensitive material capable of releasing a mobile hydrophilic dye by a simple method of heating in a substantially water free state is heated to release a mobile dye and the mobile dye is transferred into a dye-fixing layer mainly in the presence of a solvent.

SUMMARY OF THE INVENTION

As a result of further pursuing the investigation on the foregoing our previous invention, the inventors have disclosed a process of easily transferring a mobile dye formed by heating a light-sensitive material in a substantially water free state into a dye-fixing layer by heating without supplying any solvennt and have succeeded in obtaining the present invention based on the discovery.

An object of this invention is, therefore, to provide a process of fixing a dye formed by heat development performed after or simultanteously with an image exposure into a dye-fixing layer without particularly supplying any solvent from the outside.

Another object of this invention is to provide a dye fixing material for fixing dyes formed by a heat development of a light-sensitive material without particularly supplying any solvent from the outside.

That is, the invention is a dry image-forming process which comprises transferring a dye or dyes imagewise formed on a silver halide light-sensitive material comprising a support having thereon a light-sensitive silver halide, a binder, and at least one mobile dye-forming compound which forms a dye in the chemical relation of the compound upon the reduction reaction of the silver halide to silver by the heat development of the light-sensitive material after or simultaneously with an image exposure, into a dye-fixing layer in the presence of a thermal solvent at a high-temperature state at which the thermal solvent is in a molten state. This process is conducted without supplying any solvent from the outside. Furthermore, the object of the present invention can be preferably attained by using a dye-fixing material comprising a support having formed thereon one or plural layers containing a dye-fixing agent and a base or a base precursor for increasing the dye image density.

DESCRIPTION OF THE PREFERRED EMBODIMENT

Now, by heating the light-sensitive material used in this invention in a substantially water free state after or simultaneously with an image exposure, a silver image and a mobile dye image are obtained at either the exposed area or the unexposed area with the silver halide having latent nuclei as a catalyst. This development state is called "heat development" in this invention. By the heat development only, it is diffilcult to discriminate or separate the mobile dye image thus formed or released since unreacted dye-forming material (a dye-forming material in this invention includes a dye-forming and dye-releasing material), unreacted silver halide, developed silver, etc., exist together with the dye image as well as the preservative property of the dye image is greatly reduced by the existence of these materials. However, in this case, since the dye of the dye image obtained in this case is a mobile dye, the dye can be transferred to the dye-fixing layer in an atomsphere having an affinity with the dye, whereby a dye image having an excellent quality and an excellent preservative property can be obtained. This step is the "dye-fixing" step in this invention. This step can be realized by mainly supplying a solvent as described in Japanese Patent Application Nos. 157,798/'81; 177,611/'81 (corresponding to European Patent Nos. 76492 and 79065, respectively) and 31,976/'82 but in the present invention, the atmosphere having an affinity with a dye is realized by the existence of a thermal solvent and hence there is no necessary of supplying a solvent. Accordingly, in the present invention, a dye image having a good color reproducibility is formed by a complete dry process which does not require the supply of a solvent in the whole steps from image exposure to the heat development and dye fixing.

This principle is essentially same in the case of using a negative-working silver halide emulsion and in the case of using an autopositive silver halide emulsion as the silver halide emulsion of the light-sensitive material except only that the developed area is the exposed area in the former while the developed area is the unexposed area in the latter and hence a dye image having a good color reproducibility can be also obtained in the case of using an autopositive silver halide emulsion as the case of using a negative-working silver halide emulsion.

The term "heating" in a substantially water free state in this invention means heating at 80° C. to 250° C. and the term "substatially water free state" means that the reaction system in an equilibrium state with the moisture in the air and hence water is not particularly supplied to the system for causing the reaction or accelerating the reaction. Such a state is described in, for example, *The Theory of the Photographic Process*, 4th Edition, (Edited by T. H. James), published by Macmillan Co.

The term "forming a mobile dye in the chemical relation with the reaction of reducing silver halide into silver by heating" in this invention means the following three cases. That is, in, for example, a negative-working silver halide emulsion, a development nuclei are formed in the silver halide by light-exposure, the silver halide causes a redox reaction with a reducing agent or a reducible dye-forming material, and (1) the reducing agent is oxidized to form an oxidation product of it and the oxidaton product reacts with a compound capable of forming or releasing a mobile dye to form or release the mobile dye, (2) a dye-releasing material which does not essentially release a mobile dye by heating causes a redox reaction with the remaining reducing agent to release a mobile dye, or (3) the reducible dye-releasing material which essentially releases a mobile dye by heating is oxidized to become a material not releasing a mobile dye. When a positive-working silver halide emulsion is used in place of a negative-working silver halide emulsion, the foregoing reactions occur at the unexposed areas. In case (1), a dye image which is in a positive relation for the silver image is obtained, while in cases (2) and (3), dye images in a negative relation with the silver image are obtained.

As the compound forming or releasing a mobile dye used in this invention, there are following compounds.

(1) A dye-releasing compound capable of releasing a mobile dye by causing a reaction with the oxidation product of reducing agent formed by the redox reaction with silver halide caused by heating (a compound releasing a mobile dye by the foregoing reaction (1)).

These compounds are described in Japanese Patent Application No. 17,761/'81 (corresponding to European Patent No. 79065). The compound is represented by general formula C-L-D (wherein D represents an image-forming dye moiety described hereinafter; L represents a linkage group cleaving the C-L bond upon the reaction of the oxidation product of the reducing agent and C; and C represents a substrate to be bonded to the oxidation product of the reducing agent. The substrate includes, for example, a group having an active methylene, a group having an active methine, a phenol residue, and a naphthol residue, and preferably the compounds shown by following general formulae (A) to (G):

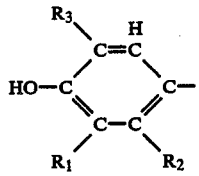
(A)

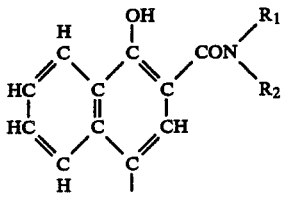
(B)

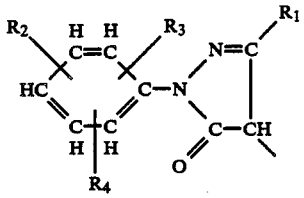
(C)

$R_1COCHCOR_2$ (D)

-continued (E)

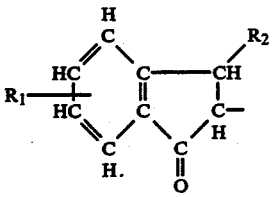

(F)

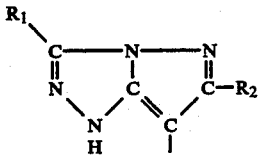

(G)

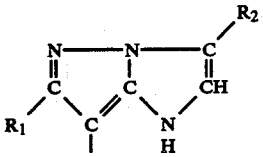

In the above formulae, $R^1$, $R^2$, $R^3$ and $R^4$ each represents a hydrogen atom, an alkyl group, a cycloalkyl group, an aryl group, an alkoxy group, an aryloxy group, an aralkyl group, an acyl group, an acylamino group, an alkoxyalkyl group, an aryloxyalkyl group, an N-substituted carbamoyl group, an alkylamino group, an arylamino group, a halogen atom, an acyloxy group, an acyloxyalkyl group, and a cyano group and further each of these groups may further substituted with a hydroxy group, a cyano group, a nitro group, an N-substituted sulfamoyl group, a carbamoyl group, an N-substituted carbamoyl group, an acylamino group, an alkylsulfonylamino group, an arylsulfonylamino group, an alkyl group, an aryl group, an alkoxy group, an aryloxy group, an aralkyl group, or an acyl group.

The substrate C must have a function of releasing a mobile dye by bonding to the oxidation product of the reducing agent and have a ballast group for rending the dye-releasing material non-diffusible into a dye-receptive image-receiving layer (dye-fixing layer). As the preferred ballast group, there are hydrophobic groups such as an alkyl group, an alkoxyalkyl group, an aryloxyalkyl group, etc. It is preferred that these ballast groups have at least 6 carbon atoms and also it is preferred that the total carbon number of the substrate C is 12 or more.

The linkage group L bonds the substrate C with the dye moiety by covalent bonds and it also has a function as a releasing group upon the reaction of the oxidation product of the reducing agent and the substrate C. The linkage group L is a divalent residue.

It is desirable that a dye-releasing material itself does not diffuse to a dye-fixing layer and only the dye released upon the reaction of the dye-releasing material and an oxidation product of a reducing agent diffuses to and dyes the dye-fixing layer in a high density. Therefore, it is preferable that a dye-releasing material has a ballast group in the substrate group C in order to prevent the dye-releasing material to diffuse to a dye-fixing layer, and the dye moiety D does not have any group which prevent the diffuse of the dye released to the dye-fixing layer.

Preferable examples of the dye-releasing materials are disclosed in European Patent No. 79056.

(2) A coupler capable of forming a mobile dye by the coupling reaction thereof with the oxidation product of the reducing agent formed by the redox reaction with silver halide caused by heating (a compound forming a mobile dye by the foregoing reaction (1)).

As such a coupler, there are couplers each having a cleavage group possessing a sufficient non-diffusible group for imparting a non-diffusible property to the coupler as described in Japanese Patent Application (OPI) 149046/83 and 149047/83.

The non-diffusible property in this case is a state that the movement of the molecule in a binder is restricted mainly by the size and the form of the molecule. The non-diffusible property is imparted to a coupler by incorporating a non-diffusible ballast group into the cleavage group of the coupler. On the other hand, the dye formed by the reaction of the coupler and the oxidation product of the reducing agent is very mobile since the dye does not have a ballast group.

Such a non-diffusible coupler is a substrate capable of forming a dye by bonding to the oxidation product of the reducing agent formed by the reaction of the reducing agent (such as a p-aminophenol derivative and a p-phenylenediamine derivative) and a silver halide and the substrate includes the compounds shown by following general formulae (I) to (IX):

(I)

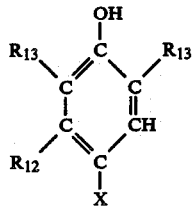

(II)

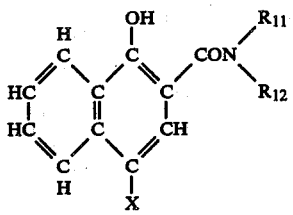

(III)

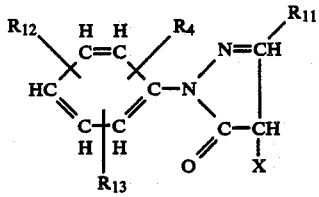

(IV)

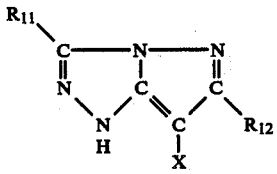

-continued (V)

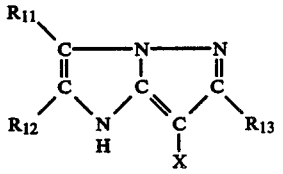

(VI)

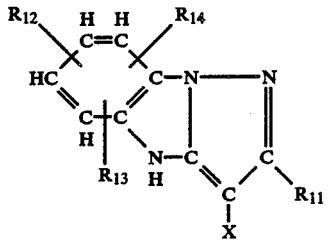

(VII)

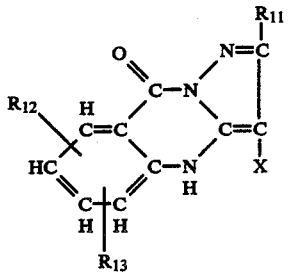

(VIII)

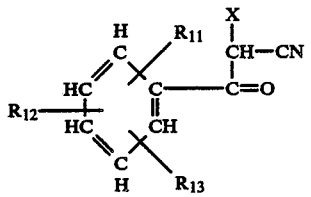

(IX)

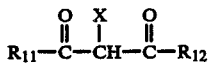

In the above formulae, $R_{11}$, $R_{12}$, $R_{13}$ and $R_{14}$ each represents a hydrogen atom, an alkyl group, an alkenyl group, a cycloalkyl group, an aryl group, an aralkyl group, an alkoxy group, an aryloxy group, an acyl group, an acyloxy group, an acylamino group, an alkoxyalkyl group, an aryloxyalkyl group, an alkoxycarbonyloxy group, an alkoxycarbonylamino group, an alkoxycarbonyl group, a carbamoyl group, a substituted carbamoyl group, a sulfamoyl group, a substituted sulfamoyl group, an amino group, an alkylamino group, a dialkylamino group, an arylamino group, a cycloalkylamino group, a halogen atom, a cyano group, an acyloxyalkyl group, a nitro group, an alkylsulfonyl group, an arylsulfonyl group, a hydroxy group, a carboxy group, a sulfo group, a ureido group, a substituted ureido group, a sulfamoylamino group, a substituted sulfamoylamino group, an alkylsulfonyloxy group, an arylsulfonyloxy group, an alkylsulfonylamino group, an arylsulfonylamino group, an alkylthio group, an arylthio group, a heterocyclic residue, an imido group, and a quaternary ammonium group. Also, each of these substituents may further be substituted by a hydroxy group, a carboxy group, a sulfo group, an alkoxy group, a cyano group, a nitro group, an alkyl group, an aryl group, an aryloxy group, an acyloxy group, an acyl group, a sulfamoyl group, a substituted sulfamoyl group, a carbamoyl group, a substituted carbamoyl group, an acylamino group, an alkylsulfonylamino group, an arylsulfonylamino group, a sulfamoylamino group, a substituted sulfamoylamino group, an imido group, a halogen atom or a quaternary ammonium group. The total carbon atom numbers of $R_{11}$ to $R_{14}$ is 12 or less and the carbon atom number of each substituent is 8 or less.

Also, X in the foregoing formulae is a group which will be released upon bonding to the oxidation product of the reducing agent and includes a substituent such as an alkoxy group, an aryloxy group, an acyloxy group, an alkoxycarbonyloxy group, a carbamoyloxy group, a substituted carbamoyloxy group, an alkylsulfonyloxy group, an arylsulfonyloxy group, an alkylsulfonylamino group, an arylsulfonylamino group, a perfluoroacylamino group, a sulfamoylamino group, a substituted sulfamoylamino group, an alkylsulfonyl group, an arylsulfonyl group, an alkylthio group, an arylthio group, a heterocyclicthio group, an arylazo group, a heterocyclic residue, or an imido group. Each of these substituents may further be substituted by an alkyl group, an alkenyl group, a cycloalkyo group, an aralkyl group, an aryl group, a halogen atom, an alkoxy group, an aryloxy group, an acyl group, an acylamino group, an acyloxy group, an alkylsulfonylamino group, an arylsulfonylamino group, an alkylsulfonyloxy group, an arylsulfonyloxy group, an alkoxycarbonyl group, a substituted ureido group, an alkoxycarbonyloxy group, or an alkoxycarbonylamino group. The total carbon number of X is 8 or more.

As described above, the foregoing coupler is combined with the oxidation product of the reducing agent to form a mobile dye and it is desirable that the coupler itself be not mobile. For the purpose, it is preferred that each of the substituents $R_{11}$ to $R_{14}$ in foregoing general formulae (I) to (IX) does not hinder the diffusion of the dye formed in a binder and practically such a substituent is preferably has a low molecular weight, and when the binder is hydrophilic the substituents are preferably relatively hydrophilic. On the other hand, it is preferred that the substituent X is a group having a large molecular weight, and is a hydrophobic group when the binder is hydrophilic, capable of controlling the diffusion of the coupler itself, i.e., serving as a ballast group.

(3) A non-diffusible compound which does not originally release a dye but releases a mobile dye when it is reduced (corresponding to the foregoing reaction (2)). The compound causing an intramolecular nucleophilic reaction described in U.S. Pat. No. 4,139,379 corresponds to the compound (3).

As the non-diffusible dye-releasing compound which does not originally release dye but releases a dye when it is reduced (hereinafter, the compound is referred to as a reducible dye-releasing compound), there is, for example, a ballasted compound which releases a mobile dye by causing an intramolecular displacement.

The reducible dye-releasing compound used in this invention becomes useful when the compound is used in combination with an electron donor (i.e., a compound which is a reducing agent and provides at least one electron necessary for enabling the reduction of the reducible dye-releasing compound into a form of accepting the intramolecular nucleophilic displacement). When the electron donor is provided in a light sensitive material in an imagewise distribution by image exposure, an electron is provided from the electron donor to an immobile ballasted electron-accepting nucleophilic displacement compound in accordance with an image pattern, which results in successively causing the imagewise displacement to release a dye.

The foregoing compound as the reducible dye-releasing compound, which has been found to be particularly useful for the heat development color photographic process and for the photographic elements used for the process, can be represented by the following schematic formula;

$$(\text{Ballasted carrier})_x(\text{Electrophilic cleavage group})_y(\text{Diffusible dye moiety})_z$$

wherein x, y and z are positive integers, preferably 1 or 2; which includes compounds having one or more diffusible moieties attached to one ballast group or one or more ballasts attached to one diffusible moiety. The ballasted carrier is a group capable of rendering said compound immobile under heat diffusion transfer conditions and said ballasted carrier contains a group capable of providing a nucleophilic group (a group capable of causing an intramolecular nucleophilic displacement with said electrophilic cleavage group) upon accepting at least one electron.

The foregoing reducible dye-releasing compound contains the electrophilic cleavage group in a linkage connecting the ballasted carrier to the respective diffusible moiety and upon reaction with the electrophilic cleavage group, a part of the nucleophilic group formed by reduction remains with the ballasted carrier and a part of the group remains with the diffusible moiety.

The reducible dye-releasing compound used in this invention contains a nucleophilic precursor group and an electrophilic cleavage group connected to each other through a linkage group.

A practical example of the preferred reducible dye-releasing compound of this invention has 1 to about 5 atoms, preferably 3 to 4 atoms between the atoms forming, respectively, the reaction center of the nucleophilic reaction and the reaction center of the electrophilic reaction, and can be represented by general formula (I)

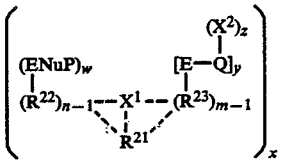

(I)

wherein w, x, y, z, n and m are 1 or 2; ENuP is an electron accepting nucleophilic group precursor such as, for example, a precursor for a hydroxyamino group [including a nitroso group (NO), a stable nitroxyl free radical (N—O) or, preferably a nitro group ($NO_2$)] or a precursor for a hydroxy group [preferably an oxo group (=0)], etc., or an imino group (which is hydrolyzed to an oxo group before accepting an electron in an alkaline environment; $R^{21}$ is an organic group containing less than 50 atoms, preferably less than 15 atoms, is preferably a cyclic organic group (including a bridged ring group); $R^{22}$ and $R^{23}$ are a divalent organic group having 1 to 3 atoms in a divalent linkage group and may be an alkylene group or may be oxaalkylene, thiaalkylene, azaalkylene, or alkyl- or aryl-substituted nitrogen, including large groups in side chains on said linkage group, which can function as a ballast, e.g., groups containing at least 8 carbon atoms and these groups are $X^1$ when $X^1$ itself is a ballast group; E and Q provide an electrophilic cleavage group, wherein E is a center of the electrophilic reaction; Q is a group providing a monoatomic linkage between E and $X^2$, wherein the monoatom is a non-metallic atom belonging to group Va or VIa of the periodic table in a -2 or -3 valence state, e.g., an oxygen atom, a sulfur atom or a selenium atom. These atoms provide two covalent bonds attaching $X^2$ to E, whereby forming a 5- to 7-membered ring together with $X^2$, and when these atoms are trivalent atoms, the group may be mono-substituted by a hydrogen atom, an alkyl group having 1 to 20 carbon atoms, preferably 1 to 10 carbon atoms (including substituted carbon atom and carbocyclic group), or an aryl group (including a substituted aryl group) having 6 to 20 carbon atoms; $X^1$ is a substituent on at least one of $R^{21}$, $R^{22}$ and $R^{23}$, one of $X^1$ and Q—$X^2$ represents a sufficiently large ballast group for rendering the foregoing compound immobile in the light-sensitive material, the other of them is a photographically useful dye or precursor for the dye, and $X^1$ and Q—$X^2$ includes a linkage group necessary for attaching each moiety to E or $R^{21}$, $R^{21}$, $R^{22}$ and $R^3$ are so elected as providing a substantial proximity to E or ENuP for allowing the intramolecular nucleophilic release of Q from E. They are so selected as providing 1 or 3 to 5 atoms between the atom forming the reaction center of the nucleophilic reaction and the atom forming the reaction center of the electrophilic reaction, whereby the foregoing compound can form a 3- or 5- to 7-membered ring.

(4) A compound which originally releases a mobile dye by heating but becomes a compound not releasing mobile dye by causing a redox reaction with a silver halide by heating (the compound used in the foregoing reaction (3)).

As such a dye-releasing compound, there are the reduction products of the compounds at the nucleophilic groups thereof described in U.S. Pat. No. 4,139,379 and they are shown by following general formula (IA) or (IB)

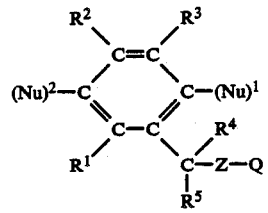

(IA)

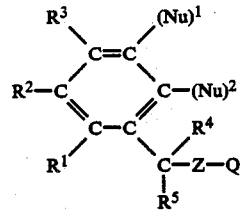

(IB)

wherein $(Nu)^1$ and $(Nu)^2$ each represents a nucleophilic group (e.g., —OH group and $NH_2$— group); Z represents a divalent atom group (e.g., a sulfonyl group) electrically negative to the carbon atom having $R^4$ and $R^5$ as substituents; Q represents a dye moiety; $R^1$, $R^2$ and $R^3$ each represents a hydrogen atom, a halogen atom, an alkyl group, an alkoxy group, or an acylamino group; when said $R^1$ and $R^2$ are at adjacent positions on the ring, the remainder of the molecule forms a condensed ring or when said $R^2$ and $R^3$ are at adjacent positions, the remainder of the molecule forms a condensed ring; and $R^4$ and $R^5$, which may be the same or different, each represents a hydrogen atom, a hydrocarbon group, or a substituted hydrocarbon group; at least one of said $R^1$, $R^2$, $R^3$, $R^4$ and $R^5$ includes a non-diffusible group, i.e., a group having a sufficiently large size for making immobile the foregoing compound.

The residue imparting a non-diffusable property is a residue that the movement of a compound having the residue can be restrained in a hydrophilic colloid usually used for photographic materials. Usually, an organic residue capable of carrying a straight chain or branched aliphatic group or a carbocyclic group having 8 to 20 carbon atoms, a heterocyclic ring group, or an aromatic group is preferably used for the purpose. These residues are attached to the remainders of the molecules directly or though, for example, —NHCO—, —$NHSO_2$—, —NR— (wherein R represents a hdyrogen atom or an alkyl group), —O—, —S— or —$SO_2$—. The residue imparting diffusion resistance or non-diffusible property may further have a group giving a solubility in water, such as a sulfo group and a carboxy group (there groups may exist as the form of an anion). The mobility of a compound is determined by the size of the whole molecule of the compound and hence in a certain case, in the case that the size of the whole molecule is sufficiently large, it is sufficiently possible that the compound has a group having a shorter chain length as "the non-diffusible resiue".

Other example of the dye-releasing compound is shown by general formula (II)

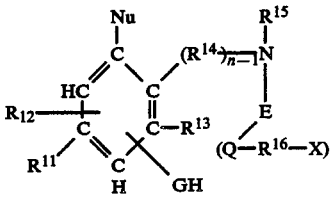

(II)

wherein Nu represents a nucleophilic group (e.g., —$NH_2$ group and —OH group); GH represents an oxidizable group [e.g., an amino group (including an alkylamino group) and a sulfonamido group], said GH is also a cyclic group formed with $R^{11}$ or $R^{13}$ or an optional group specified on Nu; E is an electrophilic group, which may be either a carbonyl (—CO—) group or a thiocarbonyl (—CS—) group; Q is a group providing a monoatomic linkage between E and $R^{16}$, wherein the monoatom is a non-metallic atom belonging to group Va or VIa of the periodic table in a -2 or -3 valence state, such as a nitrogen atom, an oxygen atom, a sulfur atom, and a selenium atom, wherein these atoms provide two covalent bonds attaching E to $R^{16}$, when these atoms are trivalent atoms, the group is substituted with a hydrogen atom, an alkyl group having 1 to 10 carbon atoms (including substituted alkyl groups), an aromatic group having 5 to 20 carbon atoms (including aryl groups and substituted aryl groups), or an atomic group (e.g., a pyridine group or a piperidine group) necessary for forming a 5- to 7-membered ring with $R^{16}$; $R^{14}$ is an alkylene group (including substituted alkylene groups) containing 1 to 3 carbon atoms in the linkage group or at least one methylene group in said linkage group is a dialkylmethylene or diarylmethylene linkage group; n is an integer of 1 to 2; $R^{16}$ can be an aromatic group containing at least 5 atoms, preferably 5 to 20 atoms, which includes a heterocyclic ring group such as a group having a nucleus as pyridine, tetrazole, benzimidazole, benztriazole, or isoquinoline or a carbocyclic arylene group containing 6 to 20 carbon atoms (preferably a phenylene group or a naphthylene group, a substituted phenylene group or a substituted naphthylene group); said $R^{16}$ may be an aliphatic hydrocarbon group containing 1 to 12 carbon atoms, such as an alkylene (may be substituted) group; $R^{15}$ can be an alkyl group containing 1 to 40 carbon atoms (including substituted alkyl groups and a cycloalkyl group) or an aryl group having 6 to 40 carbon atoms (including substituted aryl group), each group may have a function as a ballast group.

$R^{13}$, $R^{11}$ and $R^{12}$ each may be a monoatomic substituent such as a hydrogen atom or a halogen atom but is preferably a polyatomic substituent such as an alkyl group containing 1 to 40 carbon atoms (including substituted alkyl groups and a cycloalkyl group), an alkoxy group, an aryl group containing 6 to 40 carbon atoms (including substituted aryl groups), an alkylcarbonyl group, an arylcarbonyl group, a sulfamoyl group, and a sulfonamide group; said $R^{12}$ and $R^{11}$ must, however, be polyatomic substituents when $R^{16}$ is an aliphatic hydrocarbon group such as an alkylene group; and $R^{14}$ is selected to provide a substantial proximity to E of the nucleophilic group for allowing the intramolecular nucleophilic reaction accompanying the release of Q, whereby the said compound can form a 5- to 8-membered ring, most preferably 5- or 6-membered ring by the intramolecular nucleophilic displacement of group —(Q—$R^{16}$—$X^3$) from the foregoing electrophilic group.

Generally, the dye-forming compound is used in an amount of 0.01–4 moles, preferably 0.05 to 2 moles per mole of a siliver halide.

The dye moiety contained in the compound of this invention are derived from a hydrophilic dye or hydrophobic dye. It is preferably derived from a hydrophilic dye such as an azo dye, an azomethine dye, anthraquinone dye, a naphthoquinone dye, a styryl dye, a nitro dye, a quinoline dye, a carbonyl dye, a phthalocyanine dye and a metal complex salts of them.

The dye precursor represented by the general formula (IA), (IB) and (II) is typically a compound giving a dye by hydrolysis and examples of the dye precursor are acylated promotors of dyes (temporary short wave-type dye) as described in, for example, Japanese Patent Application (OPI) No. 125,818/'73 and U.S. Pat. Nos. 3,222,196 and 3,307,947. By temporarily shifting the absorption wave of the dye to a short wave side by acylation until at least exposure, the occurrence of desensitization based on the absorption of light by the color image-forming agent in the light-sensitive silver halide emulsion can be prevented. In addition, a dye showing a different hue between the case of being transferred onto a mordanting layer and the case of existing in a silver halide emulsion layer can be utilized. In addition, the dye moiety can have a group imparting water-solubility, such as a carboxy group and a sulfoamido group.

Examples of dyes which can be used for image forming dye include azo dyes, azomethine dyes, anthraquinone dyes, naphthoquinone dyes, styryl dyes, nitro dyes, quinoline dyes, carbonyl dyes and phthalocyanine dyes, etc. Representative examples of them are set forth below and are classified by hue. Further, these dyes can be used in a form temporarily shifted to shorter wavelength region which is capable of regeneration during the development processing.
Yellow:
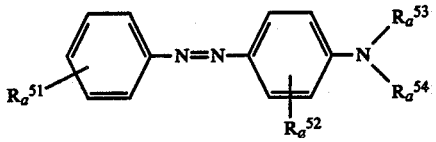
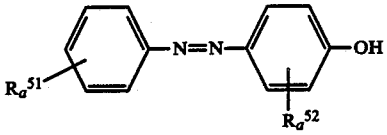
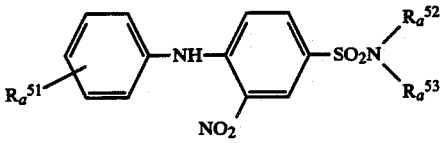
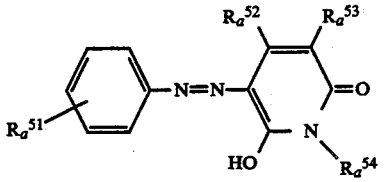
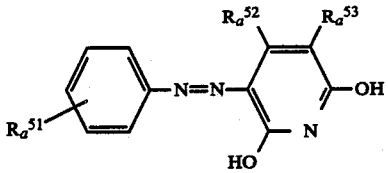
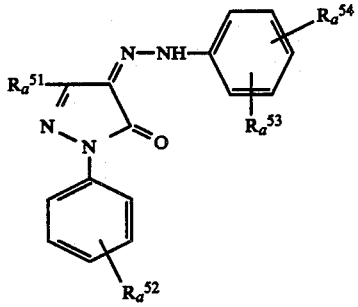
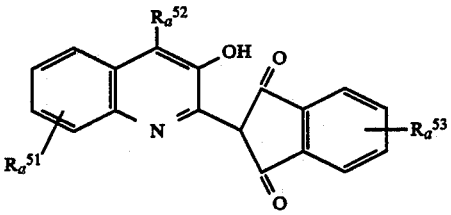
-continued
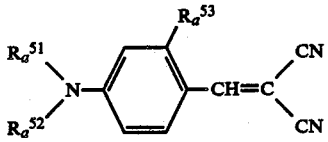
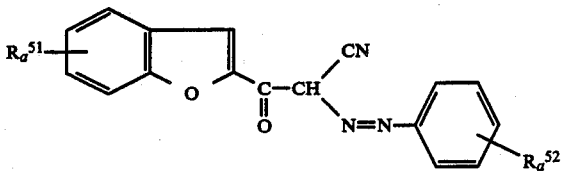
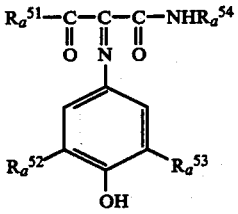
Magenta:
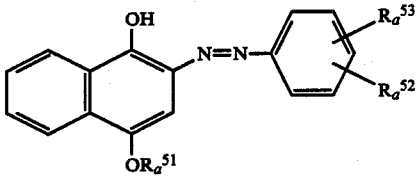
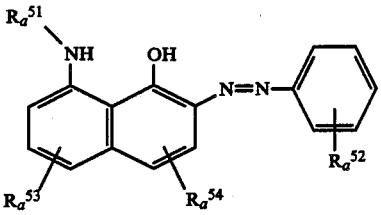
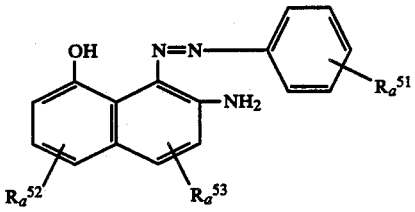
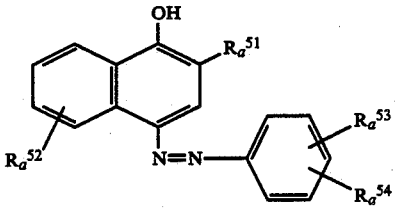

-continued
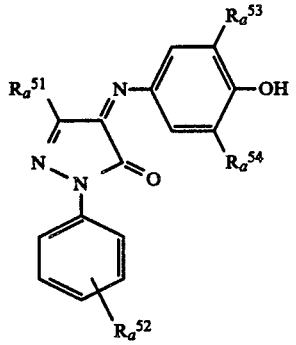
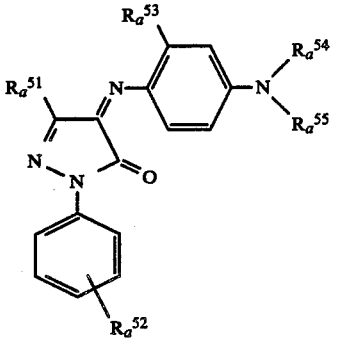
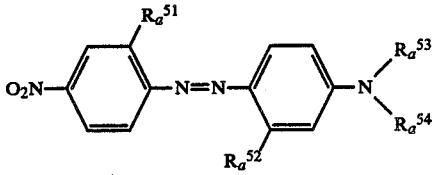
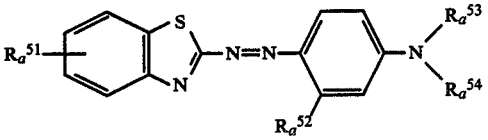
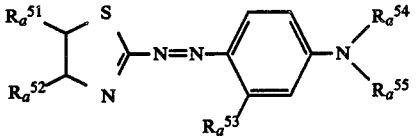
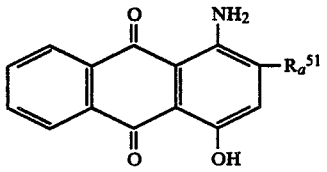
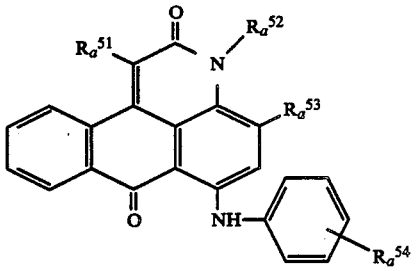
-continued
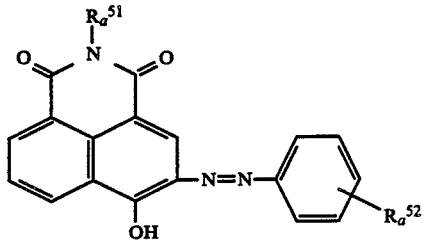
Cyan:
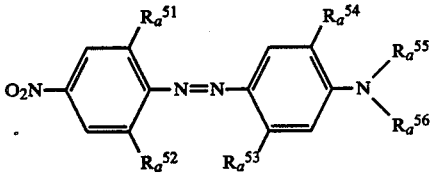
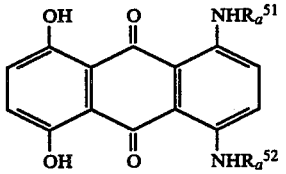
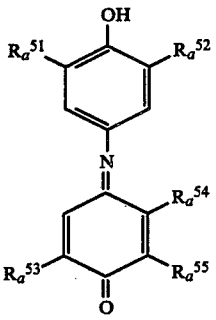
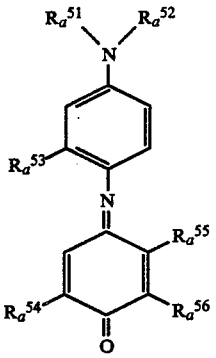
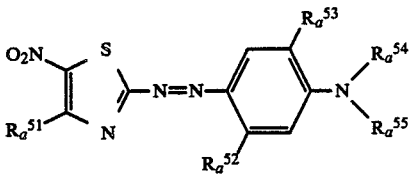

-continued

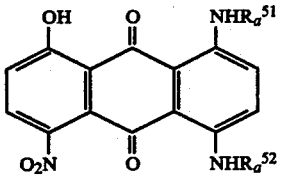

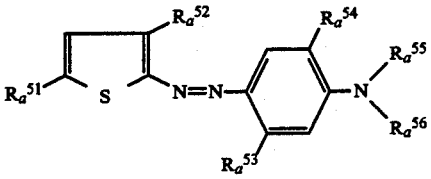

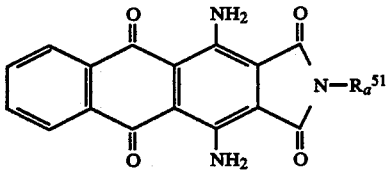

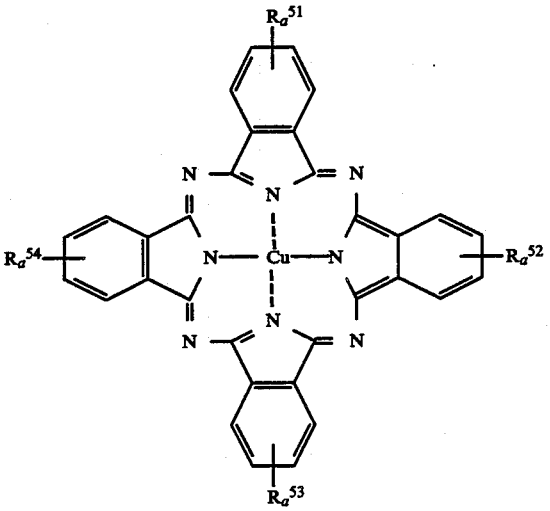

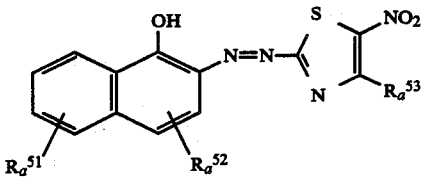

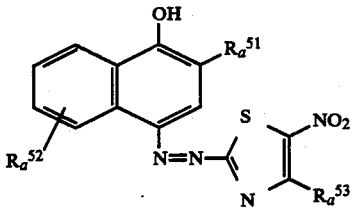

-continued

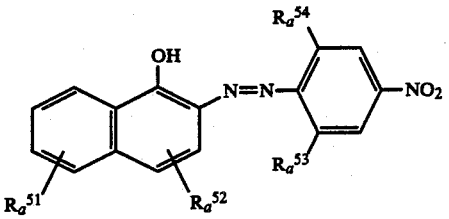

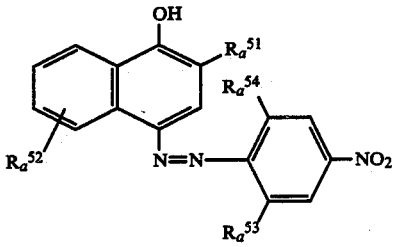

In the above described formulae, $R_a^{51}$ to $R_a^{56}$ each represents a hydrogen atom or a substituent selected from an alkyl group, a cycloalkyl group, an aralkyl group, an alkoxy group, an aryloxy group, an aryl group, an acylamino group, an acyl group, a cyano group, a hydroxyl group, an alkylsulfonylamino group, an arylsulfonylamino group, an alkylsulfonyl group, a hydroxyalkyl group, a cyanoalkyl group, an alkoxycarbonylalkyl group, an alkoxyalkyl group, an aryloxyalkyl group, a nitro group, a halogen atom, a sulfamoyl group, an N-substituted sulfamoyl group, a carbamoyl group, an N-substituted carbamoyl group, an acyloxyalkyl group, an amino group, a substituted amino group, an alkylthio group or an arylthio group. The alkyl moiety and the aryl moiety in the above described substituents may be further substituted with a halogen atom, a hydroxy group, a cyano group, an acyl group, an acylamino group, an alkoxy group, a carbamoyl group, a substituted carbamoyl group, a sulfamoyl group, a substituted sulfamoyl group, a carboxy group, an alkylsulfonylamino group, an arylsulfonylamino group or a ureido group.

Examples of the hydrophilic groups include a hydroxy group, a carboxy group, a sulfo group, a phosphoric acid group, an imido group, a hydroxamic acid group, a quaternary ammonium group, a carbamoyl group, a substituted carbamoyl group, a sulfamoyl group, a substituted sulfamoyl group, a sulfamoylamino group, a substituted sulfamoylamino group, a ureido group, a substituted ureido group, an alkoxy group, a hydroxyalkoxy group, an alkoxyalkoxy group, etc.

In the present invention, those in which the hydrophilic property thereof is increased by dissociation of a proton under a basic condition are particularly preferred. Examples of these groups include a phenolic hydroxy group, a carboxy group, a sulfo group, a phosphoric acid group, an imido group, a hydroxamic acid group, a substituted and unsubstituted sulfamoyl group, a substituted and unsubstituted sulfamoylamino group, etc.

Characteristics preferable for the image forming dye are as follows.

1. It has a hue suitable for color reproduction.
2. It has a large molecular extinction coefficient.
3. It is fast to light and heat and stable for the dye releasing activator and other additives included in the system; and 4. It is easily synthesized.

Image forming dyes are not limited to those recited above. Dye-forming compound precursor (e.g., leuco dyes and dyes of which light absorption were shifted to short waves) can also be used in the present invention.

In the cases of (2) and (3), an electron transfer agent may be incorporated in the light-sensitive material.

Preferred examples of the dye forming compound are shown below:

(1)

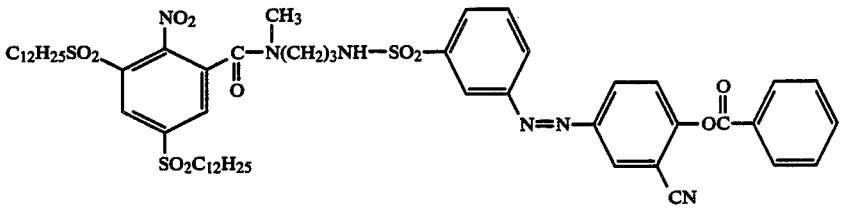

(2)

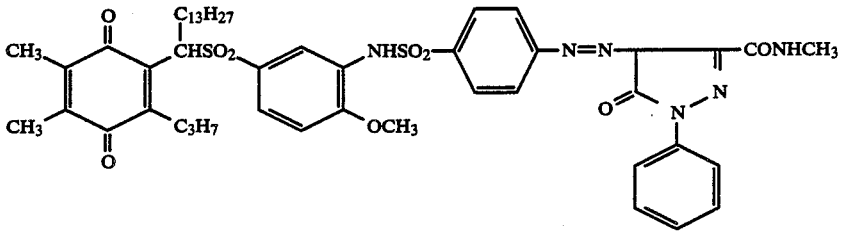

(3)

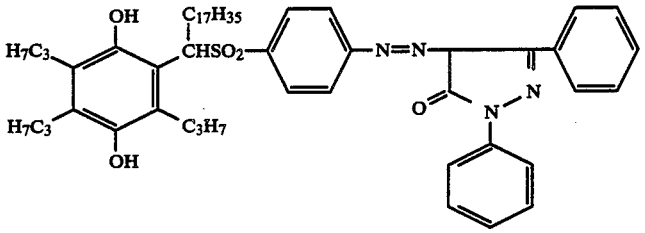

(4)

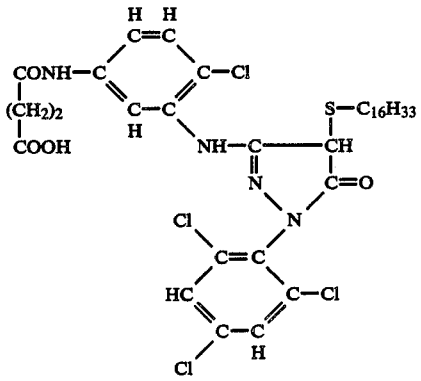

(5)

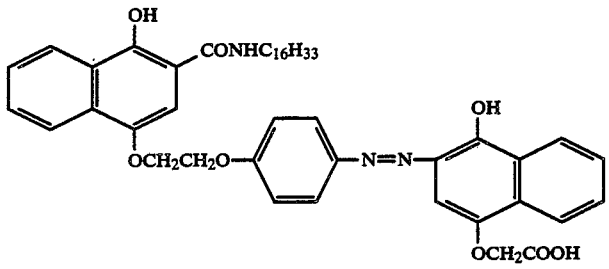

-continued
(6)
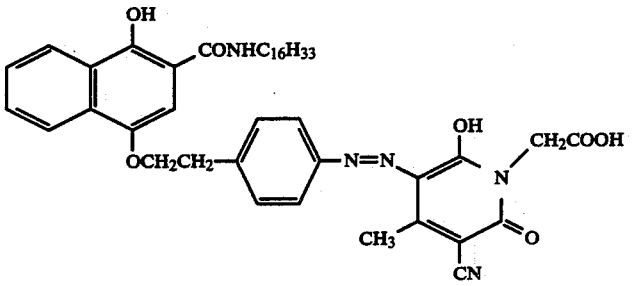
(7)
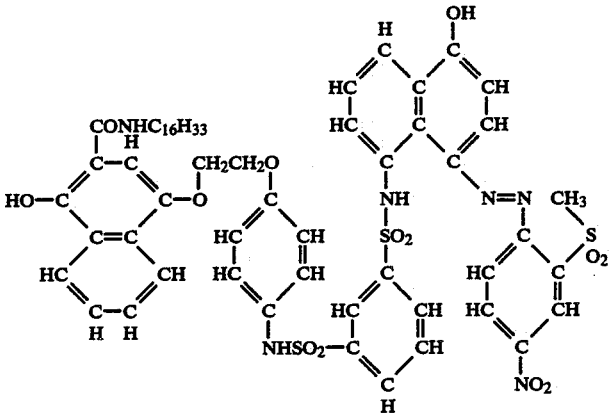
(8)
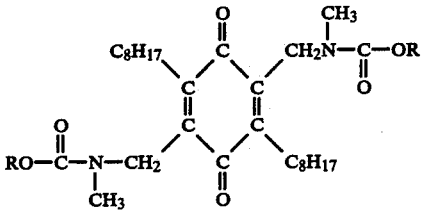
R:
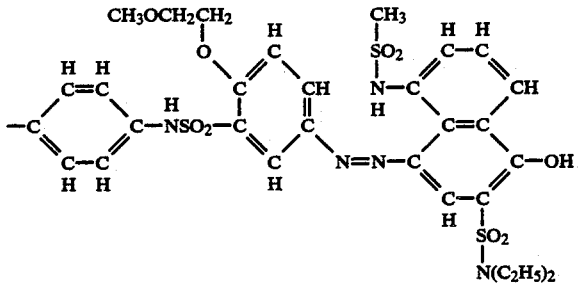
(9)
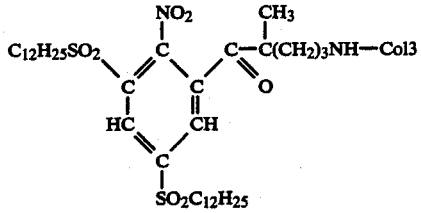
Col3:

-continued
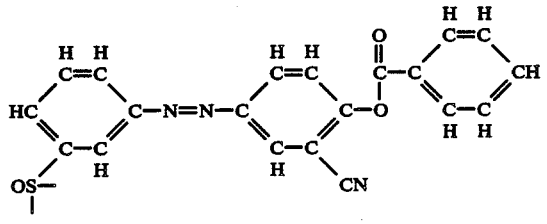
(10)
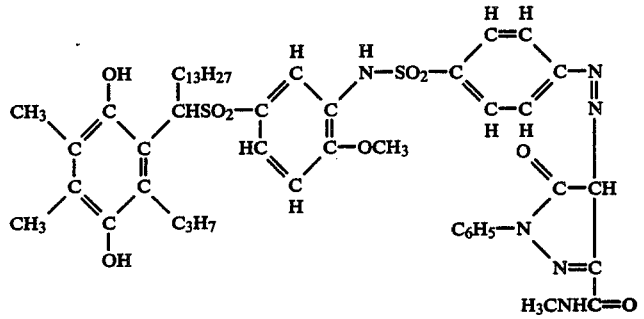
(11)
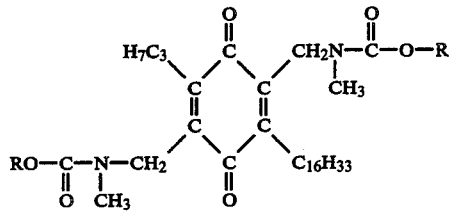
R:
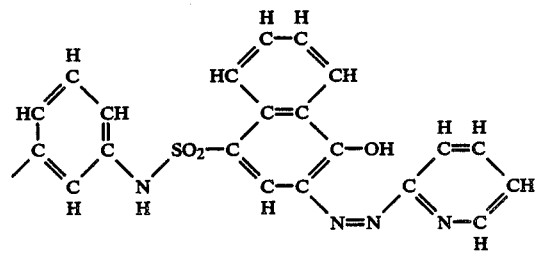
(12)
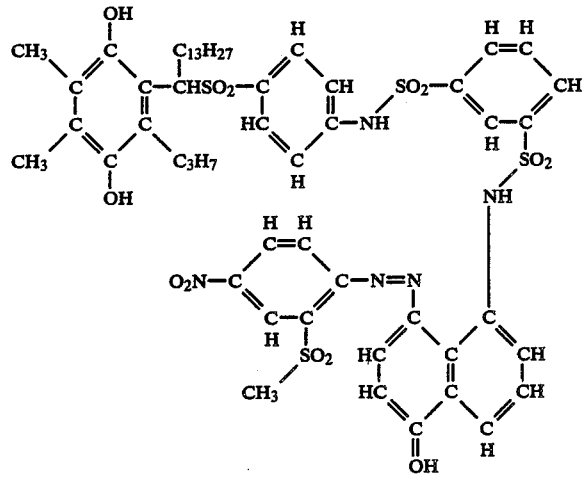

-continued (13)

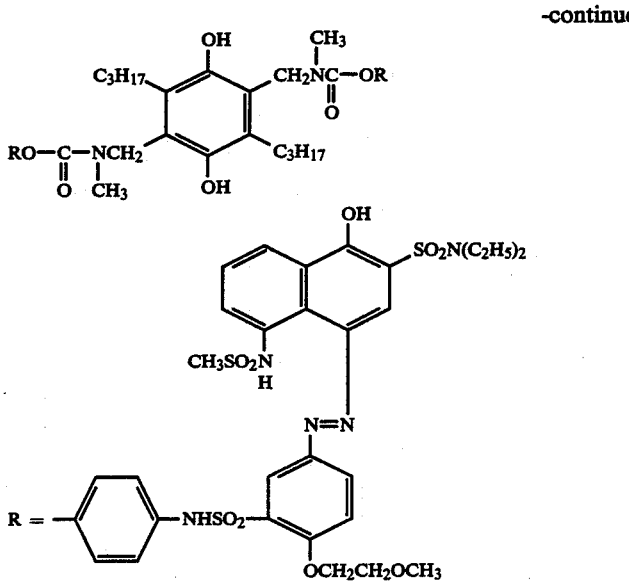

(14)

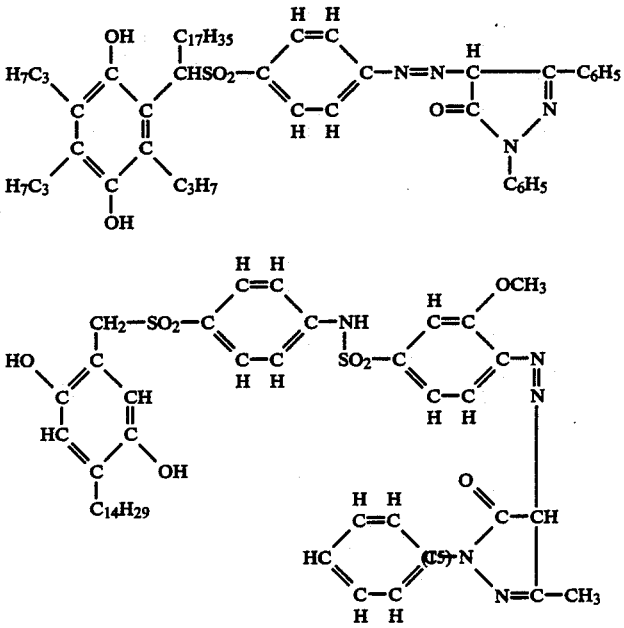

(16)

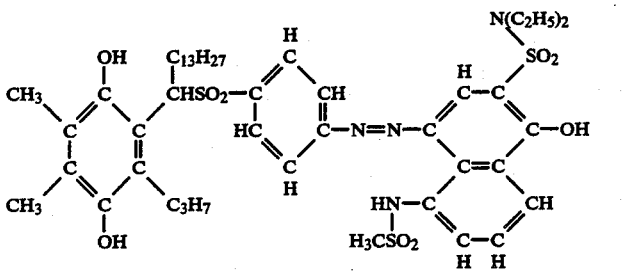

The dye forming compound used in the present invention can be introduced into a layer of the light-sensitive material by known methods such as a method as described in U.S. Pat. No. 2,322,027. In this case, an organic solvent having a high boiling point or an organic solvent having a low boiling point as described below can be used. For example, the dye releasing redox compound is dispersed in a hydrophilic colloid after dissolved in an organic solvent having a high boiling point, for example, a phthalic acid alkyl ester (for example, dibutyl phthalate, dioctyl phthalate, etc.), a phosphoric acid ester (for example, diphenyl phosphate, triphenyl phosphate, tricresyl phosphate, dioctylbutyl phosphate, etc.), a citric acid ester (for example, tributyl acetylcitrate, etc.), a benzoic acid ester (for example, octyl benzoate, etc.), an alkylamide (for example, diethyl laurylamide, etc.), an aliphatic acid ester (for example, dibutoxyethyl succinate, dioctyl azelate, etc.), a trimesic acid ester (for example, tributyl trimesate, etc.), etc., or an organic solvent having a boiling point of about 30° C. to 160° C., for example, a lower alkyl acetate such as ethyl acetate, butyl acetate, etc., ethyl propionate, secondary butyl alcohol, methyl isobutyl ketone, β-ethoxyethyl acetate, methyl cellosolve acetate, cyclohexanone, etc. The above described organic solvents having a high boiling point and organic solvents having a low boiling point may be used as a mixture thereof.

Further, it is possible to use a dispersion method using a polymer as described in Japanese Patent Publication No. 39853/76 and Japanese Patent Application (OPI) No. 59943/76. Moreover, various surface active agents can be used when the dye forming compound is dispersed in a hydrophilic colloid. For this purpose, the surface active agents illustrated hereinafter specification can be used.

An amount of the organic solvent having a high boiling point used in the present invention is 10 g per g of the dye releasing redox compound used or less and preferably 5 g per g or less.

The silver halide used in the present invention includes silver chloride, silver chlorobromide, silver chloroiodide, silver bromide, silver iodobromide, silver chloroiodobromide and silver iodide, etc.

In the embodiment of the present invention in which the organic silver salt oxidizing agent is not used together with but the silver halide is used alone, particularly preferred silver halide is silver halide partially containing a silver iodide crystal in its particle. That is, the silver halide the X-ray diffraction pattern of which shows that of pure silver iodide is particularly preferred.

In photographic materials a silver halide usually containing two or more kinds of halogen atoms can be used. Such a silver halide yields a completely mixed crystal in a conventional silver halide emulsion. For example, the particle of silver iodobromide shows X-ray diffraction pattern at a position corresponding to the mixed ratio of silver iodide crystal and silver bromide crystal but not at a position corresponding to pure silver iodide crystal and pure silver bromide crystal separately.

Particularly preferred examples of silver halide used in the present invention include silver chloroiodide, silver iodobromide, and silver chloroiodobromide each containing silver iodide crystal in its particle and showing X-ray diffraction pattern of silver iodide crystal.

The process for preparing those silver halides is explained taking the case of silver iodobromide. That is, the silver iodobromide is prepared by first adding silver nitrate solution to potassium bromide solution to form silver bromide particles and then adding potassium iodide to the mixture.

Two or more kinds of silver halides in which a particle size and/or a halogen composition are different each other may be used in mixture.

An average particle size of the silver halide used in the present invention is preferably from 0.001 μm to 10 μm and more preferably from 0.001 μm 5 μm.

The silver halide used in the present invention may be used as is. However, it may be chemically sensitized with a chemical sensitizing agent such as compounds of sulfur, selenium or tellurium, etc., or compounds of gold, platinum, palladium, rhodium or iridium, etc., a reducing agent such as tin halide, etc., or a combination thereof. The details thereof are described in T. H. James, *The Theory of the Photographic Process*, the Fourth Edition, Chapter 5, pages 149 to 169.

In the particularly preferred embodiment of the present invention, an organic silver salt oxidizing agent is used together. The organic silver salt oxidizing agent is a silver salt which forms a silver image by reacting with the above described image-forming substance or a reducing agent coexisting, if necessary, with the image-forming substance, when it is heated to a temperature of above 80° C. and, preferably, above 100° C. in the presence of exposed silver halide. By coexisting the organic silver salt oxidizing agent, the light-sensitive material which provides higher color density can be obtained.

The silver halide used in this case is not always necessary to have the characteristic in that the silver halide contains pure silver iodide crystals as in the case of using the silver halide alone. Any silver halide which is known in the art can be used.

Examples of such organic silver salt oxidizing agents include the following compounds.

A silver salt of an organic compound having a carboxy group. Typical examples thereof include a silver salt of an aliphatic carboxylic acid and a silver salt of an aromatic carboxylic acid.

Examples of the silver salts of aliphatic carboxylic acids include silver behenate, silver stearate, silver oleate, silver laurate, silver caprate, silver myristate, silver palmitate, silver maleate, silver fumarate, silver tartarate, silver furoate, silver linolate, silver oleate, silver adipate, silver sebacate, silver succinate, silver acetate, silver butyrate and silver camphorate, etc. These silver salts which are substituted with a halogen atom or a hydroxy group are also effectively used.

Examples of the silver salts of aromatic carboxylic acid and other carboxyl group containing compounds include silver benzoate, a silver substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc., silver gallate, silver tannate, silver phthalate, silver terephthalate, silver salicylate, silver phenylacetate, silver pyromellitate, a silver salt of 3-carboxymethyl-4-methyl-4-thiazoline-2-thione, etc., a described in U.S. Pat. No. 3,785,830, and a silver salt of an aliphatic carboxylic acid containing a thioether group as described in U.S. Pat. No. 3,330,663, etc.

In addition, a silver salt of a compound containing a mercapto group or a thione group and a derivative thereof can be used.

Examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-mercaptobenzothiazole, a silver salt of 2-(S-ethylglycolamido)benzothiazole, a silver salt of thioglycolic acid such as a silver salt of an S-alkyl thioglycol acetic acid (wherein the alkyl group has from 12 to 22 carbon atoms) as described in Japanese Patent Application (OPI) No. 28221/73, a silver salt of dithiocarboxylic acid such as a silver salt of dithioacetic acid, a silver salt of thioamide, a silver salt of 5-carboxyl-1-methyl-2-phenyl-4-thiopyridine, a silver salt of mercaptotriazine, a silver salt of 2-mercaptobenzoxazole, a silver salt of mercaptooxadiazole, a silver salt as described in U.S. Pat. No. 4,123,274, for example, a silver salt of 1,2,4-mercaptotrizole derivative such as a silver salt of 3-amino-5-benzylthio-1,2,4-triazole, a silver salt of thione compound such as a silver salt of 3-(2-carboxyethyl)-4-methyl-4-thiazoline-2-thione as described in U.S. Pat. No. 3,301,678, and the like.

Further, a silver salt of a compound containing an imino group can be used. Examples of these compounds include a silver salt of benzotriazole and a derivative thereof as described in Japanese Patent Publication Nos. 30270/69 and 18416/70, for example, a silver salt of benzotriazole, a silver salt of alkyl substituted benzotriazole such as a silver salt of methylbenzotriazole, etc., a silver salt of a halogen substituted benzotriazole such as a silver salt of 5-chlorobenzotriazole, etc., a silver salt of carboimidobenzotriazole such as a silver salt of butylcarboimidobenzotriazole, etc., a silver salt of 1,2,4-triazole or 1-H-tetrazole as described in U.S. Pat. No. 4,220,709, a silver salt of carbazole, a silver salt of saccharin, a silver salt of imidazole and an imidazole derivative, and the like.

Moreover, a silver salt as described in *Research Disclosure*, Vol. 170, No. 17029 (Jun. 1978) and an organic metal salt such as copper stearate, etc., are the organic metal salt oxidizing agent capable of being used in the present invention.

Two or more organic silver salt oxidizing agents can be used together.

In this invention, a reducing agent can be used if necessary. The reducing agent in this case is a so-called auxiliary developing agent and is a compound which is oxidized by a silver halide and/or an organic silver salt oxidizing agent to form an oxidation product, which cannot any longer reduce the reducible dye-releasing compound but can contribute to the reduction of the reducible dye-releasing compound at the unexposed areas.

Examples of useful auxiliary developing agents include hydroquinone, alkyl substituted hydroquinones such as tertiary butylhydroquinone, 2,5-dimethylhydroquinone, etc., catechols, pyrogallols, halogen substituted hydroquinones such as chlorohdyroquinone, dichlorohydroquinone, etc., alkoxy substituted hydroquinones such as methoxyhydroquinone, and polyhydroxybenzene derivatives such as methyl hydroxynaphthalene, etc. Further, methyl gallate, ascorbic acid, ascorbic acid derivatives, hydroxylamines such as N,N-di(2-ethoxyethyl)hydroxylamine, etc., pyrazolidones such as 1-phenyl-3-pyrazolidone, 4-methyl-4-hydroxymethyl-1-phenyl-3-pyrazolidone, etc., reductones and hydroxy tetronic acids are useful.

The auxiliary developing agent can be used in an amount of a fixed range. A suitable range is 0.0005 time by mol to 20 times by mol based on silver. A particularly suitable range is 0.001 time by mol to 4 times by mol.

In this invention, as a reducing agent, a color developing agent forming an image by causing oxidative coupling is used. As the reducing agent used for heat developable color light-sensitive materials, there are described p-phenylenediamine series color developing agents such as N,N-diethyl-3-methyl-p-phenylenediamine in U.S. Pat. No. 3,531,286. Furthermore, as useful reducing agents, there are described aminophenols in U.S. Pat. No. 3,761,270. Particularly useful examples of the aminophenol reducing agents are 4-amino-2,6-dichlorophenol, 4-amino-2-methylphenol sulfate, 4-amino-3-methylphenol sulfate, 4-amino-2,6-dichlorophenol hydrodichloride, etc. Moreover, 2,6-dichloro-4-substituted sufonamidophenol, 2,6-dibromo-4-substituted sulfonamidophenol, etc., described in *Research Disclosure*, Vol. 151, No. 15108 and U.S. Pat. No. 4,021,240 are also advantageously used as the reducing agent. In addition to the aforesaid phenol series reducing agents, naphthol series reducing agents such as 4-amino-1-naphthol derivatives and 4-substituted sulfonamido-1-naphthol derivatives are also useful in this invention. Still further, as general reducing agents used in this invention, there are aminohdyroxypyrazole derivatives described in U.S. Pat. No. 2,895,825; aminopyrazoline derivatives described in U.S. Pat. No. 2,892,714; and hydrazone derivatives described in *Research Disclosure*, Jun. 1980, pages 227–230 and pages 236–240 (RD-19413 and RD-19415).

Among the foregoing reducing agents, the reducing agents having a hdyrophilic group (e.g., $—SO_3—$, —COO—, —OH, $—SONH_2$, $—CONH_2$, etc.,) can be preferably used. These reducing agents may be used solely or as a combination of them.

The reducing agent can be used indefinite concentration. In general, the concentration of the reducing agent is about 0.01 mole to about 20 moles, preferably about 0.1 mole to about 4 moles per mole of an oxidizing agent or a coupler in the layer to which the reducing agent is added.

In this invention, the following reducing agent can be used, if necessary, as an auxiliary developing agent.

In the case of using an organic silver salt oxidizing agent together, it is necessary the silver halide and the organic silver salt oxidizing agent are disposed in a substantially effective distance for quickly initiating the reaction. Thus, it is desired that the silver halide and the organic silver halide oxidizing agent are in the same layer of a light-sensitive material.

In the development by heating, it takes a long time to finish the reaction since the diffusion of reaction molecules is restricted in the heat development different from a so-called wet development. However, if heating for development is performed for a too long time, the heat reaction at the unexposed areas cannot be disregarded and so-called fog undesirably forms.

In order to overcome such defects, it is possible to use a thermal solvent. The term "thermal solvent" means a non-hydrolyzable organic material which is solid at an ambient temperature but melts together with other components at a temperature of heat treatment or below but higher than 40° C. Preferred examples of thermal solvents include compounds which can act as a solvent for the developing agent and compounds having a high dielectric constant which accelerate physical development of silver salts. Examples of preferred thermal solvents include polyglycols as described in U.S. Pat. No. 3,347,675, for example, polyethylene glycol having an average molecular weight of 1,500 to 20,000, derivatives of polyethylene oxide such as polyethylene oxide oleic acid ester, etc., beeswax, monostearin, compounds having a high dielectric constant which have an $—SO_2—$ or —CO— group such as acetamide, succinimide, ethylcarbamate, urea, methylsulfonamide or ethylene carbonate, polar substances as described in U.S. Pat. No. 3,667,959, lactone of 4-hydroxybutanoic acid, methylsulfinylmethane, tetrahydrothiophene-1,1-dioxide, and 1,10-decanediol, methyl anisate and biphenyl suberate as described in *Research Disclosure*, pages 26 to 28 (Dec., 1976), etc.

The role of the heat solvent in this invention is not always clear but the main role thereof is considered to promote the diffusion of reaction molecules at development.

The light-sensitive silver halide and the organic silver salt oxidizing agent used in the present invention are prepared in the binder as described below. Further, the dye forming compound is dispersed in the binder described below.

The binder which can be used in the present invention can be employed individually or in a combination thereof. A hydrophilic binder can be used as the binder according to the present invention. The typical hydrophilic binder is a transparent or translucent hydrophilic colloid, examples of which include a natural substance, for example, protein such as gelatin, a gelatin derivative, a cellulose derivative, etc., a polysaccharide such as starch, gum arabic, etc., and a synthetic polymer, for example, a water-soluble polyvinyl compound such as polyvinyl pyrrolidone, acrylamide polymer, etc. Another example of the synthetic polymer compound is a dispersed vinyl compound in a latex form which is used for the purpose of increasing dimensional stability of a photographic material.

The silver halide used in the present invention can be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes and complex merocyanine dyes are particularly useful. Any conventionally utilized nucleus for cyanine dyes, such as basic heterocyclic nuclei, is applicable to these dyes. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei may also be substituted.

To merocyanine dyes and complex merocyanine dyes, as nuclei having a ketomethylene structure, 5- or 6-membered heterocyclic nuclei such as a pyrazolin-5-one nucleus, a thiohydantoin nucleus, a 2-thiooxazolidin-2,4-dione nucleus, a thiazolidin-2,4-dione nucleus, a rhodanine nucleus, a thiobarbituric acid nucleus, etc., may also be applicable.

Useful sensitizing dyes include those described in German Patent 929,080, U.S. Pat. Nos. 2,231,658, 2,493,748, 2,503,776, 2,519,001, 2,912,329, 3,656,959, 3,672,897, 3,694,217, 4,025,349 and 4,046,572, British Patent 1,242,588, Japanese Patent Publication Nos. 14030/69 and 24844/77, etc.

These sensitizing dyes can be employed individually, and can also be employed in combination thereof. A combination of sensitizing dyes is often used, particularly for the purpose of supersensitization.

Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Patent Nos. 1,344,281 and 1,507,803, Japanese Patent Publication Nos. 4936/68 and 12375/78, Japanese Patent Application (OPI) Nos. 110618/77 and 109925/77, etc.

The sensitizing dyes may be present in the emulsion together with dyes which themselves do not give rise to spectrally sensitizing effects but exhibit a supersensitizing effect or materials which do not substantially absorb visible light but exhibit a supersensitizing effect. For example, aminostilbene compounds substituted with a nitrogen-containing heterocyclic group (e.g., those described in U.S. Pat. Nos. 2,933,390 and 3,635,721), aromatic organic acidformaldehyde condensates (e.g., those described in U.S. Pat. No. 3,743,510), cadmium salts, azaindene compounds, etc., can be present. The combinations described in U.S. Pat. Nos. 3,615,613, 3,615,641, 3,617,295 and 3,635,721 are particularly useful.

In this invention, a base or a base precursor can be used for accelerating the dye-forming reaction. In particular, when the light-sensitive material is of a type imagewise releasing a dye, the base or the base precursor functions as a dye releasing activator by accelerating the dye-releasing reaction.

When such a base or base precursor is incorporated in a light-sensitive material, it is necessary to select the base or base percursor which does not reduce the shelf life of the light-sensitive material.

Examples of preferred bases are amines which include trialkylamines, hydroxylamines, aliphatic polyamines, N-alkyl substituted aromatic amines, N-hydroxyalkyl substituted aromatic amines and bis[p-(dialkylamino)phenyl]methanes. Further, there are betaine tetramethylammonium iodide and diaminobutane dihydrochloride as described in U.S. Pat. No. 2,410,644, and urea and organic compounds including amino acids such as 6-aminocaproic acid as described in U.S. Pat. No. 3,506,444. The base precursor is a substance which releases a basic component by heating. Examples of typical base precursors are described in British Patent 998,949. A preferred base precursor is a salt of a carboxylic acid and an organic base, and examples of the suitable carboxylic acids include trichloroacetic acid and trifluoroacetic acid and examples of the suitable bases include guanidine, piperidine, morpholine, p-toluidine and 2-picoline, etc. Guanidine trichloroacetate as described in U.S. Pat. No. 3,220,846 is particularly preferred. Further, aldonic amides as described in Japanese Patent Application (OPI) No. 22625/75 are preferably used because they decompose at a high temperature to form base.

These dye releasing activators can be used in an amount of a broad range. A useful range is up to 50% by weight based on the amount of a dry layer coated of the light-sensitive material. A range of 0.01% by weight to 40% by weight is more preferred.

It is advantageous to use a compound represented by the general formula described below in the heat-developable color light-sensitive material in order to accelerate development and accelerate release of a dye.

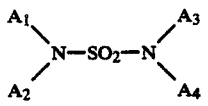

(A)

wherein $A_1$, $A_2$, $A_3$ and $A_4$, which may be the same or different, each represents a hydrogen atom or a substituent selected from an alkyl group, a substituted alkyl group, a cycloalkyl group, an aralkyl group, an aryl group, a substituted aryl group and a heterocyclic group; and $A_1$ and $A_2$ or $A_3$ and $A_4$ may combine with each other to form a ring.

Specific examples of the compounds include $H_2NSO_2NH_2$, $H_2NSO_2N(CH_3)_2$, $H_2NSO_2N(C_2H_5)_2$, $H_2NSO_2NHCH_3$, $H_2NSO_2N(C_2H_4OH)_2$, $CH_3NHSO_2NHCH_3$,

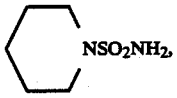

etc.

The above described compound can be used in an amount of broad range. A useful range is up to 20% by weight based on the amount of a dry layer coated of the light-sensitive material. A range of 0.1% by weight to 15% by weight is more preferred.

It is advantageous to use a water releasing compound in the present invention in order to accelerate the dye releasing reaction.

The water releasing compound means a compound which releases water by decomposition during heat development. These compounds are particularly known in the field of printing of fabrics, and $NH_4Fe(SO_4)_2.12H_2O$, etc., as described in Japanese Patent Application (OPI) No. 88386/75 are useful.

A support used in the present invention is that which can endure at the processing temperature. As an ordinary support, not only glass, paper, metal or analogues thereof may be used, but also an acetyl cellulose film, a cellulose ester film, a polyvinyl acetal film, a polystyrene film, a polycarbonate film, a polyethylene terephthalate film, and a film related thereto or a plastic material may be used. The polyesters described in U.S. Pat. Nos. 3,634,089 and 3,725,070 are preferably used.

As to the coating liquid used in this invention, separately produced silver halide and organic metal salt oxidizing agent are mixed with each to provide the coating liquid at use or both components may be mixed in a ball mill for a long time. Also, a halogen-containing compound is added to an organic metal salt oxidizing agent prepared by a any desired manner to form silver halide by the silver in the organic metal salt oxidizing agent and the halogen of the halogen-containing compound. These methods are effectively employed for preparing the liquid coating compositions in this invention.

Methods of preparing these silver halide and organic silver salt oxidizing agents and manners of blending them are described in *Research Disclosure*, No. 17029, Japanese Patent Application (OPI) Nos. 32928/75 and 42529/76, U.S. Pat. No. 3,700,458, and Japanese Patent Application (OPI) Nos. 13224/74 and 17216/75.

A suitable coating amount of the light-sensitive silver halide and the organic silver salt oxidizing agent employed in the present invention is in a total of from 50 $mg/m^2$ to 10 $g/m^2$ calculated as an amount of silver.

The photographic emulsion layer and other hydrophilic colloid layers in the light-sensitive material of the present invention may contain various surface active agents for various purposes, for example, as coating aids or for prevention of electrically charging, improvement of lubricating property, emulsification, prevention of adhesion, improvement of photographic properties (for example, acceleration of development, rendering hard tone or sensitization), etc.

For example, it is possible to use nonionic surface active agents such as saponin (steroid), alkylene oxide derivatives (for example, polyethylene glycol, polyethylene glycol/polypropylene glycol condensates, polyethylene glycol alkyl ethers or polyethylene glycol alkylaryl ethers, polyethylene glycol esters, polyethylene glycol sorbitan esters, polyalkylene glycol alkylamine or amides, polyethylene oxide adducts of silicone, etc.), glycidol derivatives (for example, alkenylsuccinic acid polyglycerides, alkylphenol polyglycerides, etc.), polyhydric alcohol aliphatic acid esters or saccharide alkyl esters, etc.; anionic surface active agents containing acid groups such as a carboxy group, a sulfo group, a phospho group, a sulfate group, a phosphate group, etc., such as alkylcarboxylic acid salts, alkylsulfonic acid salts, alkylbenzenesulfonic acid salts, alkylnaphthalenesulfonic acid salts, alkyl sulfuric acid esters, alkylphosphoric acid esters, N-acyl-N-alkyltaurines, sulfosuccinic acid esters, sulfoalkyl polyoxyethylene alkylphenyl ethers, polyoxyethylene alkylphosphoric acid esters, etc.; ampholytic surface active agents such as amino acids, aminoalkylsulfonic acids, aminoalkylsulfuric acid esters or phosphoric acid esters, alkylbetaines, amine oxides, etc.; and cationic surface active agents such as alkylamine salts, aliphatic or aromatic quaternary ammonium salts, heterocyclic quaternary ammonium salts such as pyridinium salts, imidazolium salts, etc., aliphatic or heterocyclic phosphonium salts, aliphatic or heterocyclic sulfonium salts, etc.

Of the above-described surface active agents, polyethylene glycol type nonionic surface active agents having a recurring unit of ethylene oxide in their molecules may be preferably incorporated into the light-sensitive material. It is particularly preferred that the molecule contains 5 or more of the recurring units of ethylene oxide.

The nonionic surface active agents capable of satisfying the above described conditions are well known as to their structures, properties and methods of synthesis. These nonionic surface active agents are widely used even outside this field. Representative references relating to these agents include: *Surfactant Science Series*, Vol. 1, Nonionic Surfactants (edited by Martin J. Schick, Marcel Dekker Inc., 1967), and *Surface Active Ethylene Oxide Adducts*, (edited by Schoufeldt N. Pergamon Press, 1969). Among the nonionic surface active agents described in the above mentioned references, those capable of satisfying the above described conditions are preferably employed in connection with the present invention.

The nonionic surface active agents can be used individually or as a mixture of two or more of them.

The polyethylene glycol type nonionic surface active agents can be used in an amount of less than 100% by weight, preferably less than 50% by weight, based on a hydrophilic binder.

The light-sensitive material of the present invention may contain a cationic compound containing a pyridinium salt. Examples of the cationic compounds containing a pyridinium group used are described in PSA Journal Section B 36 (1953), U.S. Pat. Nos. 2,648,604 and 3,671,247, Japanese Patent Publication Nos. 30074/69 and 9503/69, etc.

Further, in the present invention, it is possible to use a compound which activates development simultaneously while stabilizing the image. Particularly, it is preferred to use isothiuroniums including 2-hydroxyethylisothiuronium trichloroacetate as described in U.S. Pat. No. 3,301,678, bisisothiuroniums including 1,8-(3,6-dioxaoctane)-bis(isothiuronium trifluoroacetate), etc., as described in U.S. Pat. No. 3,669,670, thiol compounds as described in German Patent Application (OLS) No. 2,162,714, thiazolium compounds such as 2-amino-2-thiazolium trichloroacetate, 2-amino-5-bromoethyl-2-thiazolium trichloroacetate, etc., as described in U.S. Pat. No. 4,012,260, compounds having α-sulfonylacetate as an acid part such as bis(2-amino-2-thiazolium)methylenebis(sulfonylacetate, 2-amino-2-thiazolium phenylsulfonylacetate, etc., as described in U.S. Pat. No. 4,060,420, and compounds having 2-carboxycarboxamide as an acid part as described in U.S. Pat. No. 4,088,496.

In the present invention, though it is not so necessary to further incorporate substances or dyes for preventing irradiation or halation in the light-sensitive material, because the light-sensitive material is colored by the dye releasing redox compound, it is possible to add filter dyes or light absorbing materials, etc., as described in Japanese Patent Publication No. 3692/73 and U.S. Pat. Nos. 3,253,921, 2,527,583 and 2,956,879, etc., in order to further improve sharpness. It is preferred that these dyes have a thermal bleaching property. For example, dyes as described in U.S. Pat. Nos. 3,769,019, 3,745,009 and 3,615,432 are preferred.

The light-sensitive material used in the present invention may contain, if necessary, various additives known for the heat-developable light-sensitive materials and may have a layer other than the light-sensitive layer, for example, an antistatic layer, an electrically conductive layer, a protective layer, an intermediate layer, an antihalation layer, a strippable layer, etc.

Examples of various additives include those described in *Research Disclosure*, Vol. 170, No. 17029 (Jun., 1978), for example, plasticizers, dyes for improving sharpness, antihalation dyes, sensitizing dyes, matting agents, fluorescent whitening agents and fading preventing agent, etc.

The protective layer, the intermediate layer, the subbing layer, the back layer and other layers can be produced by preparing each coating solution and applying to a support by various coating methods such as a dip coating method, an air-knife coating method, a curtain coating method or a hopper coating method as described in U.S. Pat. No. 2,681,294 and drying in the same manner as used in preparing the heat-developable light-sensitive layer of the present invention, by which the light-sensitive material is obtained.

If necessary, two or more layers may be applied at the same time by the method as described in U.S. Pat. No. 2,761,791 and British Patent 837,095.

After the heat-developable color photographic material is exposed to light, the resulting latent image can be developed by heating the whole material to a suitably elevated temperature, for example, about 80° C. to about 250° C. for about 0.5 second to about 300 seconds. A higher temperature or lower temperature can be utilized to prolong or shorten the heating time, if it is within the above described temperature range. Particularly, a temperature range of about 110° C. to about 160° C. is useful. As said heating means, ordinary heating means such as a simple hot plate, a hot iron, a hot roller, a heating method of using a heat generator utilizing carbon, titanium white, etc., or the like can be used.

In the image-forming process of this invention wherein an image of a mobile dye is transferred into a dye-fixing layer at a high temperature state at which a thermal solvent exist, the mobile dye may be transferred simultaneously with the release of the dye or after finishing the release of the dye. Accordingly, the heating for the transfer of the dye may be after heat development or simultaneously with heat development. The term "heating simultaneously with heat development" means that the heating for the development also acts as the heating for the transfer of the dye. Since the optimum temperature for development and the heating time necessary for the development not always coincide with the optimum temperature for dye transfer and the heating time for the dye transfer, they can be selected independently.

The heating temperature for the transfer of dye is 60° C. to 250° C. from the view points of the preservative property of the images formed and workability and hence a material capable of exhibit the action as the thermal solvent in the temperature range can be properly selected. The thermal solvent is as a matter of course required to assist the quick transfer of dye by heating but considering the heat resistance, etc., of a light-sensitive material, the thermal solvent is required to have a melting point of 40° C. to 250° C., preferably 40° C. to 200° C., more preferably 40° C. to 150° C.

The "thermal solvent" in this invention is a compound which is in a solid state at normal temperature but becomes a liquid state by heating and is defined to be a compound having a (inorganicity/organicity) value $>1$ and a water solubility of higher than 1. In this case, the inorganicity and organicity are a concept for estimate the properties of a compound and is described in, for example *Kagaku no Ryoiki* (*The Domain of Chemistry*), 11, page 719 (1957).

The thermal solvent has a role of assisting the transfer of a hydrophilic dye and thus it is considered to be preferred that the thermal solvent is a compound capable of acting as a solvent for the dye.

It is generally known that in a preferred solvent for dissolving an organic compound, the (inorganicity/organicity) value of the solvent is close to the (inorganicity/organicity) value of the organic compound. On the other hand, the (inorganicity/organicity) values of the dye-forming compounds used in this invention are almost about 1 and also the (inorganicity/organicity) values of the dyes obtained from these dye-forming compounds are larger than those of the dye-forming compounds and are preferably larger than 1.5, more preferably larger than 2. Since it is preferred that the hydrophilic thermal solvent used in this invention transfers the hydrophilic dye only and does not transfer the dye-forming compound, it is necessary that the (inorganicity/organicity) value of the thermal solvent is larger than the (inorganicity/organicity) value of the dye-forming compound. That is, the (inorganicity/organicity) value of the thermal solvent is larger than 1 as a necessary condition and is preferably larger than 2.

On the other hand, from the viwe point of the size of molecule, it is considered to be preferred that at the surroundings of the transferring dye, there exist molecules which can move by themselves. Therefore, the molecular weight of the thermal solvent is as small as possible and is less than about 200, preferably less than 100.

It is enough that the thermal solvent used in this inventioncan substantially assist the transfer of the dye formed by heat development into a dye-fixing layer. Thus, the thermal solvent can be contained in the dye-fixing layer as well as in the light-sensitive layer, etc., of a light-sensitive material, in both the dye-fixing layer and the light-sensitive layer, or in an additional independent layer. From the view point of increasing the transfer efficiency of a dye into a dye-fixing layer, it is preferred that the thermal solvent be contained in the dye-fixing layer and/or an adjacent layer thereof.

The thermal solvent is usually dispersed in a binder solution as an aqueous solution thereof but may be used as a solution of alcohols such as methanol, ethanol, etc.

The thermal solvent in this invention can be used at the amount of 5–500% by weight, preferably 20–200% by weight, most preferably 30–150% by weight of the total coating amount for the light-sensitive material and/or the dye-fixing material.

The hydrophilic thermal solvent used in this invention include, for example, ureas, pyridines, amides, sulfonamides, imides, alcohols, oximes, and other heterocyclic compounds.

Then, practical examples of the hydrophilic heat solvent used in this invention are shown below. In the present invention it is preferable to use a hydrophilic thermal solvent.

(1) $H_2N\overset{O}{\overset{\|}{C}}NH_2$, (2) $H_2N\overset{O}{\overset{\|}{C}}NHCH_3$ (3) $H_2N\overset{O}{\overset{\|}{C}}NHC_2H_5$, (4) $CH_3NH\overset{O}{\overset{\|}{C}}NHCH_3$ (5) $HOCH_2NH\overset{O}{\overset{\|}{C}}NH_2$ (6) $HOCH_2NH\overset{O}{\overset{\|}{C}}NHCH_2OH$ (7) $HOC_2H_4NH\overset{O}{\overset{\|}{C}}NHC_2H_4OH$ (8) $H_2N\overset{O}{\overset{\|}{C}}NHC_2H_4OH$ (9) $H_2N\overset{O}{\overset{\|}{C}}N(C_2H_4OH)_2$ (10)

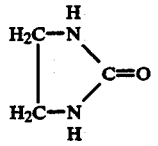

(11)

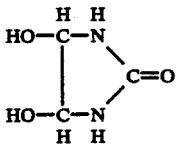

-continued

(12) $H_2N-\overset{O}{\overset{\|}{C}}-N(CH_3)_2$ (13)

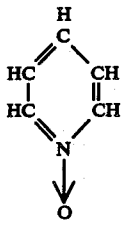

(14)

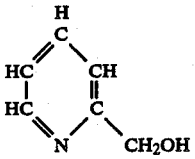

(15)

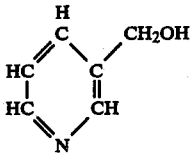

(16)

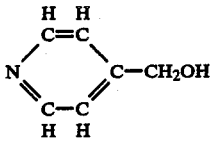

(17)

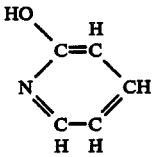

(18)

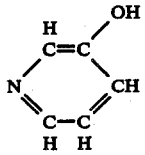

(19)

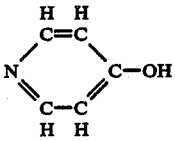

(20)

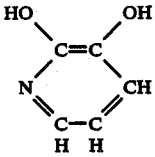

(21)

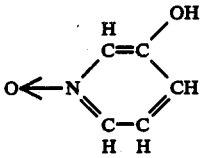

-continued
(22)
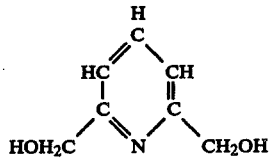
(23)
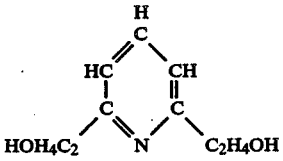
(24)
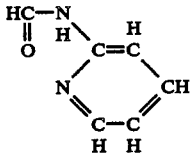
(25)
$(HCNH)_2CH_2$,
(26)
$CH_3CNH_2$
(27)
$(CH_3CNH)_2CH_2$,
(28)
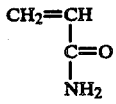
(29)
$HOC_2H_4CNH_2$,
(30)
$HOCH_2CNH_2$
(31)
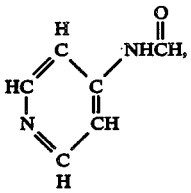
(32)
$NCCH_2CNH_2$
(33)
$(CH_3)CH—C—NH_2$
(34)
$CH_3SO_2NH_2$,
(35)
$HOCH_2SO_2NH_2$
(36)
$H_2NSO_2NH_2$,
(37)
$_3HCNHSO_2NH_2$
(38)
$HOCH_2SO_2$ , $NHCH_3$
-continued
(39)
$(CH_3)_2N$ $SO_2NH_2$
(40)
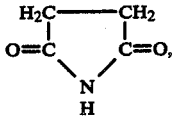
(41)
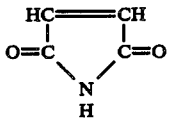
(42)
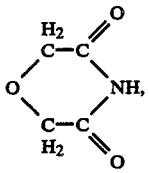
(43)
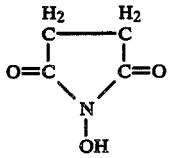
(44)
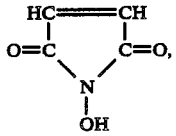
(45)
$(CH_3CO)_2NH$
(46)
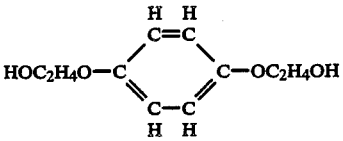
(47)
$HOCH_2(CHOH)_3CH_2OH$
(48)
$CH_3C(CH_2OH)_3$,
(49)
$C_2H_5C(CH_2OH)_3$
(50)
$O_2NC(CH_2OH)_3$,
(51)
SORBITOL
(52)
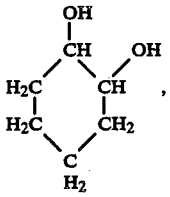
(53)
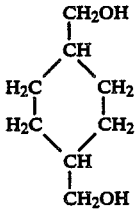

-continued $HOCH_2-CH=CH-CH_2OH$ (54)

$CH_3CH=NOH$, (55)

$HON=CHCH=NOH$ (56)

$CH_3C(=NOH)-CH_3C=O$, (57)

$HOCH_2CH=NOH$ (58)

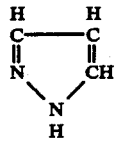 (59)

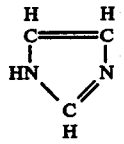 (60)

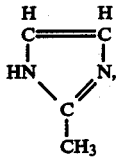 (61)

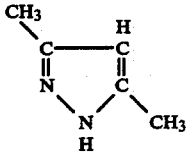 (62)

Among the foregoing compounds, the ureas (1), (2), (3) and (10), the pyridines (17) and (19), the amides (26), (30), and (33), the sulfonamides (34) and (36), the imides (40), (41), (43) and (44) and the alcohols (46) and (54) are particularly preferred. The thermal solvents in this invention may be used solely or as a mixture of them.

In this invention, a dye-fixing layer is necessary for accepting a mobile dye imagewise formed in the light-sensitive material by heat development after or simultaneously with image exposure and transferred thereto and fixing therein as a dye image. Therefore, the light-sensitive material of this invention is composed a light-sensitive layer (I) containing a silver halide, the dye-forming compound, a binder, and, if necessary, an organic metal salt oxidizing agent formed on a support and a dye-fixing layer (II) capable of accepting a mobile dye formed in the layer (I). The light-sensitive layer (I) and the dye-fixing layer (II) may be formed on a same support or may be formed on separate supports. The dye-fixing layer (II) may be separated from the light-sensitive layer (I) in the case of that the layers of (I) and (II) formed on the same support after transfering the dye image. For example, the light-sensitive material having both layers is uniformly heated after image exposure and then the dye-fixing layer (II) or the light-sensitive layer (I) may be peeled off from the other layer after transfering the dye image. Also, when a light-sensitive material having the light-sensitive layer (I) on a support and a dye-fixing material having the dye-fixing layer (II) on a support are separately prepared, after image-exposing and then uniformly heating the light-sensitive material, the dye-fixing material is superposed on the light-sensitive material, whereby a mobile dye can be transferred into the dye-fixing layer (II) of the dye-fixing material. Also, the light-sensitive material having the light-sensitive layer (I) is image-exposed and after disposing the dye-fixing material having the dye-fixing layer (II) on the light-sensitive material, the assembly may be uniformly heated for performing the heat development and the transfer of a hydrophilic dye simultaneously.

For closely contacting the light-sensitive material and the dye-fixing material, an ordinary means such as a press roller can be used and for securing the contact, heating may be applied at the contact of them.

When after heat developing after image exposure or simultaneously with image exposure, the surface of the light-sensitive material is brought into contact with the dye-receiving surface of the dye-fixing material followed by heating, said heating may for only the transfer of the dye. Thus, from this point, the heating temperature and the heating time may be selected independently from the heating for the development.

In the case of employing the foregoing method, it is preferred that the heating for the development is as short as possible for finishing the reaction for the development so that the heating less contributes to the dye transfer. On the other hand, it is preferred that the heating for transferring the mobile dye imagewise formed onto the dye-fixing layer is applied at a temperature as low as possible in a proper range of transfer time so that the heat reaction does not occur at the unexposed areas. Thus, a clear image can be obtained.

The dye-fixing layer (II) may have a white reflecting layer. For example, a layer of titanium dioxide dispersed in gelatin can be formed on a mordant layer on a transparent support. The titanium dioxide layer forms a white opaque layer and thus a reflection type color image is obtained by viewing the transferred color image from the side of the transparent support.

The transfer of dyes from the light-sensitive layer to the dye fixing layer can be carried out using a dye transfer assistant. Examples of useful dye transfer assistant include water and an alkaline aqueous solution containing sodium hydroxide, potassium hydroxide and an inorganic alkali metal salt. Further, a solvent having a low boiling point such as methanol, N,N-dimethylformamide, acetone, diisobutyl ketone, etc., and a mixture of such a solvent having a low boiling point with water or an alkaline aqueous solution can be used. The dye transfer assistant can be employed by wetting the image receiving layer with the transfer assistant or by incorporating it in the form of water of crystallization or microcapsules into the material.

The dye-fixing layer may contain a dye mordant for fixing a dye, a hydrophilic thermal solvent for assisting the transfer of dye, a base and/or a base precursor for accelerating the dye forming, etc., and further a binder for binding these components. When the dye-fixing layer is formed on a different support from that of the light-sensitive material, it is particularly preferred to contain a base and/or a base precursor in the dye-fixing layer.

When the dye mordant is a polymer mordant, the polymer mordant functions as a binder and hence in this case, the amount of a binder may be reduced or a binder may be omitted. On the contrary, when a binder has a function as a mordant, a dye mordant may not be used.

Examples of the binder, include same materials as used for light-sensitive materials.

The mordant used for the dye-fixing layer in this invention can be properly selected from the mordants usually used and among these materials, polymer mordants are particularly preferred.

Polymer mordants used in the present invention are polymers containing secondary and tertiary amino groups, polymers containing nitrogen-containing heterocyclic moieties, polymers having quaternary cation groups thereof, having a molecular weight of from 5,000 to 200,000, and particularly from 10,000 to 50,000.

For example, there are illustrated vinylpyridine polymers and vinylpyridinium cation polymers as disclosed in U.S. Pat. Nos. 2,548,564, 2,484,430, 3,148,061 and 3,756,814, etc., polymer mordants capable of cross-linking with gelatin as disclosed in U.S. Pat. Nos. 3,625,694, 3,859,096 and 4,128,538, British Patent 1,277,453, etc., aqueous sol type mordants are disclosed in U.S. Pat. Nos. 3,958,995, 2,721,852 and 2,798,063, Japanese Patent Application (OPI) Nos. 115228/79, 145529/79 and 126027/79, etc., water-insoluble mordants as disclosed in U.S. Pat. No. 3,898,088, etc., reactive mordants capable of forming covalent bonds with dyes used as disclosed in U.S. Pat. No. 4,168,976 (Japanese Patent Application (OPI) No. 137333/79), etc., and mordants disclosed in U.S. Pat. Nos. 3,709,690, 3,788,855, 3,642,482, 3,488,706, 3,557,066, 3,271,147 and 3,271,148, Japanese Patent Application (OPI) Nos. 71332/75, 30328/78, 155528/77, 125/78 and 1024/78, etc.

In addition, mordants disclosed in U.S. Pat. Nos. 2,675,316 and 2,882,156 can be used.

Of these mordants, for example, mordants capable of cross-linking with a matrix such as gelatin, water-insoluble mordants, and aqueous sol (or latex dispersion) type mordants are preferably used.

Particularly preferably polymer mordants are described below.

(1) Polymers having quaternary ammonium groups and groups capable of forming covalent bonds with gelatin (for example, aldehydo groups, chloroalkanoyl groups, chloroalkyl groups, vinylsulfonyl groups, pyridiniumpropionyl groups, vinylcarbonyl groups, alkylsulfonoxy groups, etc.), such as

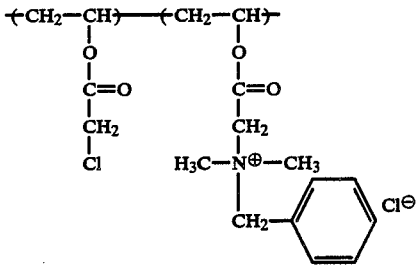

(2) Reaction products between a copolymer comprising a repeating unit of a monomer represented by the general formula described below with a repeating unit of another ethylenically unsaturated monomer and a cross-linking agent (for example, bisalkanesulfonate, bisarenesulfonate, etc.):

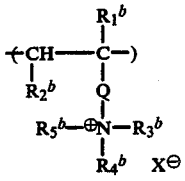

wherein $R_1^b$ represents H or an alkyl group, $R_2^b$ represents H, an alkyl group or an aryl group, Q represents a divalent group, $R_3^b$, $R_4^b$ and $R_5^b$ each represents an alkyl group, an aryl group or at least two of $R_3^b$ to $R_5^b$ are bonded together to form a hetero ring, and X represents an anion such as a halogen ion and sulfonyl ion. The above described alkyl groups and aryl groups may be substituted.

(3) Polymers represented by the following general formula

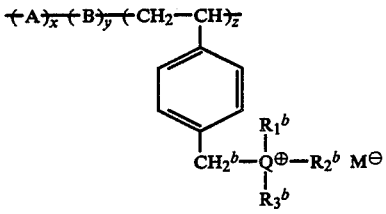

wherein x is from about 0.25 mol % to about 5 mol %, y is from about 0 mol % to about 90 mol %, z is from about 10 mol % to about 99 mol %, A represents a repeating unit derived from a monomer having at least two ethylenically unsaturated bonds, B represents a repeating unit derived from a copolymerizable ethylenically unsaturated monomer, Q represents N or P, $R_1^b$, $R_2^b$ and $R_3^b$ each represents an alkyl group or a cyclic hydrocarbon group or at least two of $R_1^b$ to $R_3^b$ are bonded together to form a ring (these groups and rings may be substituted), and M represents an anion such as a halogen ion and sulfonyl ion.

(4) Copolymers composed of (a), (b) and (c), wherein (a) is

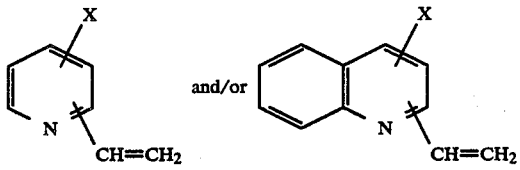

wherein X represents a hydrogen atom, an alkyl group or a halogen atom (the alkyl group may be substituted);

(b) is an acrylic ester; and (c) is acrylonitrile.

(5) Water-insoluble polymers wherein at least ⅓ of the repeating units are those represented by the following general formula

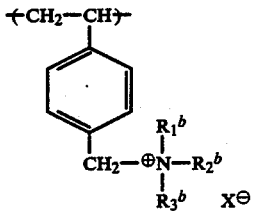

wherein $R_1^b$, $R_2^b$ and $R_3^b$ each represents an alkyl group, with the total number of carbon atoms included being 12 or more (the alkyl group may be substituted), and X represents an anion such as a halogen ion and a sulfonyl ion.

Various kinds of known gelatins can be employed as gelatin for the mordant layer. For example, gelatin which is produced in a different manner such as lime-processed gelatin, acid-processed gelatin, etc., or a gelatin derivative which is prepared by chemically modifying gelatin such as phthalated gelatin, sulfonylated gelatin, etc., can be used. Also, gelatin subjected to a desalting treatment can be used, if desired.

The ratio of polymer mordant to gelatin and the amount of the polymer mordant coated can be easily determined by one skilled in the art depending on the amount of the dye to be mordanted, the type and composition of the polymer mordant and further on the image-forming process used. Preferably, the ratio of mordant to gelatin is from 20/80 to 80/20 (by weight) and the amount of the mordant coated is from 0.5 to 8 $g/m^2$.

The typical dye-fixing material used in this invention is obtained by coating a mixture of a polymer containing an ammonium salt and gelatin on a transparent support.

When the dye-fixing layer is disposed at the surface of the dye-fixing material a protective layer may further formed on the layer. As such a protective layer, a material ordinary used for protective layers for ordinary light-sensitive materials can be used as it is but when the dye-fixing layer is formed on the dye-fixing material separately from the light-sensitive material, it is preferred to render the protective layer hydrophilic for not hindering the transfer of a hydrophilic dye into the dye-fixing layer.

In the photographic light-sensitive material and the dye fixing material of the present invention, the photographic emulsion layer and other binder layers may contain inorganic or organic hardeners. It is possible to use chromium salts (chromium alum, chromium acetate, etc.), aldehydes (formaldehyde, glyoxal, glutaraldehyde, etc.), N-methylol compounds (dimethylolurea, methylol dimethylhydantoin, etc.), dioxane derivatives (2,3-dihydroxydioxane, etc.), active vinyl compounds (1,3,5-triacryloylhexahydro-s-triazine, 1,3-vinylsulfonyl-2-propanol, etc.), active halogen compounds (2,4-dichloro-6-hydroxy-s-triazine, etc.), mucohalogenic acids (mucochloric acid, mucophenoxychloric acid, etc.), etc., which are used individually or as a combination thereof.

In this invention, a dye or dyes in the light-sensitive layer are transferred into the dye-fixing layer. In order to obtain a high image density of the dye image finally formed in the dye-fixing layer, it is particularly advantageous to contain a base or a base precursor in a layer constituting the dye-fixing material. In particular, it is preferred for obtaining a sufficient image density and a clear dye image to contain a base or a base precursor in the dye-fixing layer or a protective layer formed on the dye-fixing layer, if any. As such a base or a base precursor, the foregoing dye-forming activators used for light-sensitive materials can be used.

When the dye-fixing material is separately prepared from the light-sensitive material a function of light sensitivity and a function of fixing the final image are separately imparted to the light-sensitive material and the dye-fixing material, respectively, and hence materials capable of sufficiently exhibiting these functions can be widely selected.

As the base or base precursor used for the dye-fixing material of this invention, an inorganic or organic base or base precursor may be used. The base precursor used in this invention is a material releasing a basic component by causing the thermal decomposition thereof.

Examples of the inorganic base are hydroxides, secondary and tertiary phosphates, borates, carbonates, quinolinates, and metaborates of alkali metals or alkaline earth metals, ammonium hydroxide, hydroxides of a quaternary alkyl ammonium preferably having 1 to 10 carbon atoms, and other hydroxides. Practical examples of the inorganic bases used in this invention are lithium hydroxide, sodium hydroxide, potassium hydroxide, barium hydroxide, sodium carbonate, potassium carbonate, sodium quinolinate, potassium quinolinate, sodium secondary phosphate, potassium secondary phosphate, sodium tertiary phosphate, potassium tertiary phosphate, sodium pyrophosphate, potassium pyrophosphate, sodium metaborate, potassium metaborate, borax, ammonium hydroxide, tetramethyl ammonium, tetrabutyl ammonium, ammonia, etc.

As the organic bases used in this invention, there are aliphatic amines, aromatic amines, heterocyclic amines, amidines, cyclic amidines, guanidines, cyclic guanidines, etc., and the foregoing organic bases having a pKa of not less than 8 are particularly useful in this invention. Also, the precursors of these organic bases are used as preferred base precursors in this invention. Examples of the base precursors are thermally decomposable salts of the base and organic acids such as trichloroacetic acid, cyanoacetic acid, acetoacetic acid, etc., and the salts with 2-carboxycarboxamides described in U.S. Pat. No. 4,088,496. Furthermore, the base precursors described in U.K. Pat. No. 998,945; U.S. Pat. No. 3,220,846; and Japanese Patent Publication (Unexamined) No. 22,625/'75 can be used in this invention and also the bases usually used for photographic light-sensitive materials and processing solutions therefor as an alkaline agent or a buffer can be also used.

Practical examples of the preferred organic base precursors used in this invention are guanidine trichloroacetate, piperidine trichloroacetate, morpholine trichloroacetate, p-toluidine trichloroacetate, 2-picoline trichloroacetate, etc., and examples of the organic bases include the following compounds;

$MeNH_2$ $Me_2NH$ $EtNH_2$ $Et_2NH_2$ $C_4H_8NH_2$ $(C_4H_9)_2NH$ $HOC_2H_4NH_2$ $(HOC_2H_4)_2NH$ $H_2NC_2H_4NH_2$ $MeNH-C_2H_4NHMe$ $Me_2N-C_2H_4NH_2$

-continued
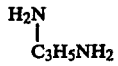
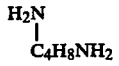
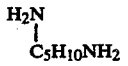
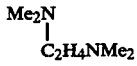
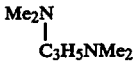
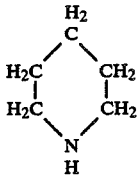
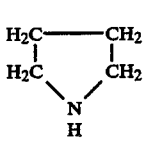
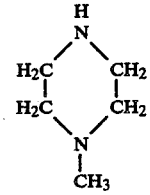
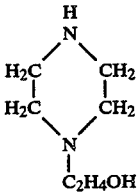
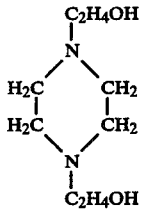
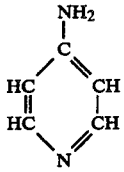
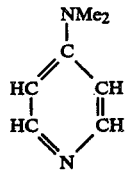
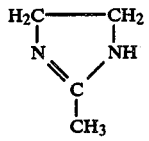
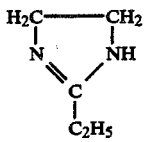
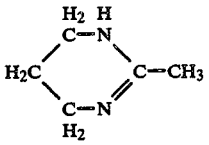
-continued
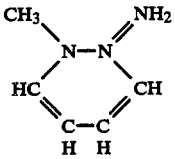
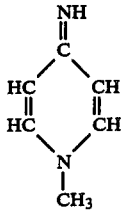
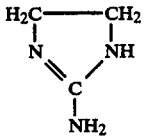
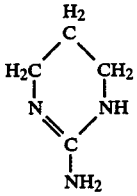
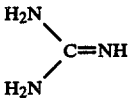
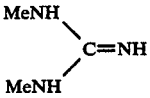
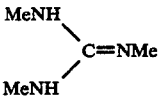
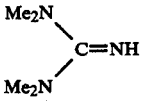
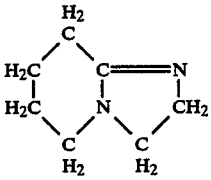
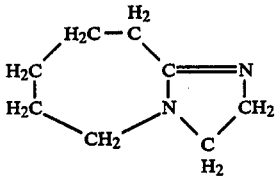
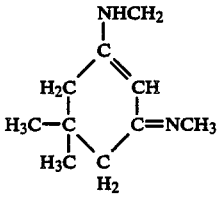

-continued

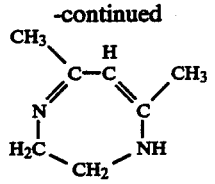

Examples of electron donors are shown below:

ED-(1)

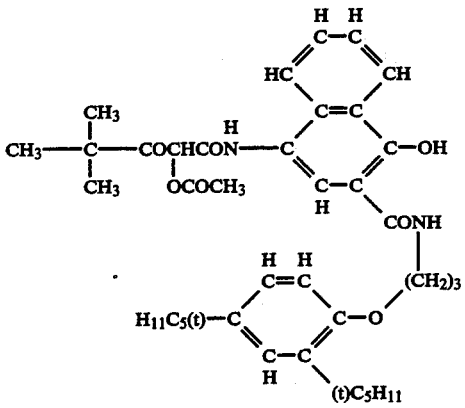

ED-(2)

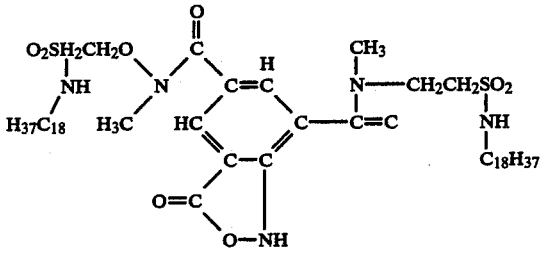

ED-(3)

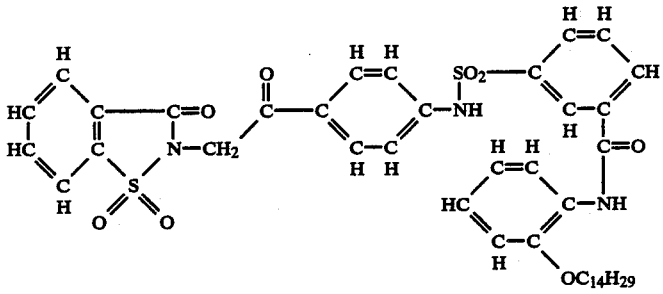

ED-(4)

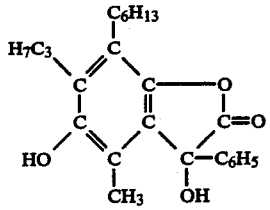

Also, as the heating means for transferring dye, the foregoing heating means at the heat development and also various similar heating means may be employed.

In this invention, the light-sensitive material is produced by preparing coating liquids for a dye-fixing layer, a protective layer, interlayers, a subbing layer, a backing layer, etc., as the case of producing the heat developable light-sensitive layer and coating the coating liquids on a support by a coating method, such as a dip method, an air knife method, a curtain coating method, or a hopper coating method as described in U.S. Pat. No. 3,681,294 followed by drying.

If necessary, two or more layers may be simultaneously coated by the method described in U.S. Pat. No. 2,761,791 and U.K. Patent No. 837,095.

The base or base precursor used in this invention can be used in a wide range. The useful amount of the base or base precursor is not more than 50% by weight, preferably 0.01% by weight to 40% by weight of the weight of the total coating amount of the dye-fixing material. The foregoing bases and base precursors can be used solely or as a mixture of them.

The base and/or the base precursor are dissolved in water or an alcohol and then dispersed in a coating composition for the dye-fixing layer as the solution thereof. In this case, the dispersion of the base and/or the base precursor may be performed using a high boiling organic solvent as described in U.S. Pat. No. 2,322,027 or may be performed using a low-boiling organic solvent having a boiling point of about 30° C. to 160° C., such as a lower alkyl acetate such as ethyl acetate, butyl acetate, etc., ethyl propionate, socondary butyl alcohol, methyl isobutyl ketone, β-ethoxyethyl acetate, methylcellosolve acetate, cyclohexane, etc.

Examples of the high boiling organic solvent used for the purpose are phthalic acid alkyl esters (e.g., dibutyl phthalate, dioctyl phthalate, etc.,), phosphoric acid esters (e.g., diphenyl phosphate, triphenyl phosphate, tricresyl phosphate, dioctylbutyl phosphate, etc.,), citric acid esters (e.g., tributyl acetylcitrate, etc.,), benzoic acid esters (e.g., octyl benzoate, etc.,), alkylamides (e.g., diethyllaurylamide), aliphatic acid esters (e.g., dibutoxyethyl succinate, dioctyl azerate, etc.,), trimesic acid esters (e.g., tributyl trimesate, etc.,), and the like. The foregoing high boiling organic solvent may be used as a mixture with the low boiling organic solvent. Furthermore, a dispersion method by the polymer described in Japanese Patent Publication No. 39,853/'76 and Japanese Patent Publication (Unexamined) No. 59,943/'76 can be also used in this invention.

The dye-fixing layer of this invention may be composed of a single layer or plural layers and contains a dye mordant for fixing dye. The base and/or the base precursor is dispersed in the dye mordant layer. In other embodiment of this invention, the base and/or the base precursor is dispersed in a binder of any layer adjacent to the dye mordant layer. As the dye mordant, various mordants may be used and particularly useful mordant is a polymer mordant. The polymer mordant and the base and/or the base precursor can be dispersed in the following binders and the binders can be used solely or as a combination of them. It is preferred to use hydrophilic binders when the dye is hydrophilic. Transparent or translucent hydrophilic binders are typical binders in this invention and examples of these binders are proteins such as gelatin, gelatin derivatives, cellulose derivatives, etc.; natural materials such as starch, gum arabic, dextrin, pullulan etc.; and synthetic polymers as water-soluble polyvinyl compounds such as polyvinyl alcohol, polyvinylpyrrolidone, acrylamide polymers, etc. Other synthetic polymer includes a dispersion-form vinyl compound for improving the dimensional stability of a photographic material as the form of a latex.

In this invention, when the dye mordant is a polymer mordant, the mordant functions as a binder and hence in such a case, the amount of binder used may be reduced or a binder may not be used. Binders usually used for light-sensitive materials can be used in this invention.

When the dye-fixing layer is disposed at the surface of the dye-fixing material, a protective layer may be further formed thereof if necessary. As the protective layer, the materials used as protective layers for ordinary photographic light-sensitive materials can be used as they are but in this invention wherein the dye-fixing layer is formed on the dye-fixing material separately from the light-sensitive material, it is preferred to impart a hydrophilic property to the protective layer for not dindering the transfer of the hydrophilic dye.

As the support for the dye-fixing material of this invention, the supports for the light-sensitive materials may be properly used but high-molecular weight polymers having heat resistance to heatings for heat development and dye transfer into the dye-fixing layer are preferred.

Practical examples of the high polymers used as the support for the dye-fixing material of this invention are polymers having a molecular weight of 2000 to 85000. Such polymers include polystyrene, a polystyrene derivative having a substitutent of 4 or less carbon atoms, polyvinylcyclohexane, polydivinylbenzene, polyvinylpyrrolidone, polyvinylcarbazole, polyallylbenzene, polyvinyl alcohol, a polyacetal such as polyvinyl formal and polyvinyl butyral, polyvinyl chloride, chlorinated polyethylene, poly-trichlorofluoroethylene, polyacrylonitrile, poly-N, N-dimethylallylamide, a polyester such as polyacrylate having a p-cyanophenyl group, a pentachlorophenyl group, and a 2,4-dichlorophenyl group, polyacryl chloroacrylate, polymethyl methacrylate, polyethyl methacrylate, polypropyl methacrylate, polyisopropyl methacrylate, polyisobutyl methacrylate, poly-t-butyl methacrylate, polycyclohexyl methacrylate, polyethylene glycol dimethacrylate, poly-2-cyanoethyl methacrylate, and polyethylene terephthalate, polysulfone, bisphenol A polycarbonate, polycarbonates, polyanhydride, polyamides, and cellulose acetates. Also, the synthetic polymers described in *Polymer Handbook*, 2nd Edition, (Edited by J. Brandrup and E. H. Immergut), published by John Wiley & Sins Co., are useful in this invention. These materials may be used solely or as a combination of them.

Examples of the particularly useful support are films of cellulose acetate such as triacetate, diacetate, etc.; films of a polyamide such as a combination of heptamethylenediamine and terephthalic acid, fluorodipropylamine and adipic acid, hexamethylenediamine and diphenic acid, hexamethylenediamine and isophthalic acid, etc.; films of a polyester such as a combination of diethylene glycol and diphenylcarboxylic acid, bis-p-carboxyphenoxybutane and ethylene glycol, etc.; polyethylene terephthalate films, polycarbonate films, etc. These films may be modified. For example a polyethylene terephthalate film modified by a modifier such as cyclohexane dimethanol, isophthalic acid, methoxy polyethylene glycol, 2-dicarbomethoxy-4-benzenesulfonic acid, etc., is effectively used.

Various means of exposure can be used in the present invention. Latent images are obtained by imagewise exposure by radiant rays including visible rays. Generally, light sources used for conventional color prints can be used, examples of which include tungsten lamps, mercury lamps, halogen lamps such as iodine lamps, xenon lamps, laser light sources, CRT light sources, fluorescent tubes and light-emitting diodes, etc.

The original may be line drawings or photographs having gradation. Further, it is possible to take a photograph of a portrait or landscape by means of a camera. Printing from the original may be carried out by contact printing by superposing the original on the material or may be carried out by reflection printing or enlargement printing.

It is also possible to carry out the printing of images photographed by a videocamera or image informations sent from a television broadcasting station by displaying on a cathode ray tube (CRT) or a fiber optical tube (FOT) and focusing the resulting image on the heat-developable photographic material by contacting therewith or by means of a lens.

Recently, light-emitting diode (LED) systems which have been greatly improved have begun to be utilized as an exposure means or display means for various apparatus and devices. It is difficult to produce an LED which effectively emits blue light. In this case, in order to reproduce the color image, three kinds of LEDs consisting of those emitting each green light, red light and infrared light are used. The light-sensitive material to be sensitized by these lights is produced so as to release a yellow dye, a magenta dye and a cyan dye, respectively.

The light-sensitive material is produced using a construction such that the green-sensitive part (layer) contains a yellow dye releasing redox compound, the red-sensitive part (layer) contains a magenta dye releasing redox compound and the infrared-sensitive part (layer) contains a cyan dye releasing redox compound. Other combinations can be utilized, if necessary.

In addition to the above described methods of contacting or projecting the original, there is a method of exposure wherein the original illuminated by a light source is stored in a memory of a reading computer by means of a light-sensitive element such as a phototube or a charge coupling device (CCD). The information is, if necessary, subjected to processing, the so-called image treatment, and resulting image information is reproduced on CRT which can be utilized as an image-like light source or lights are emitted by three kinds of LED according to the processed information.

The image-forming process of this invention can be performed by a complete dry process without particularly supplying solvent from the outside in the whole steps from image exposure to heat development and dye fixing and hence is a very simple image-forming process. Furthermore, in the image-forming process of this invention, the speed of a so-called conventional silver halide photographic material can be maintained as well as since a dye image formed in fixed in a dye-fixing material, the quality and the stability of the dye image formed are very good and the color reproducibility is good. Also, in spite of a complete dry process, the production of color images can be sufficiently performed. Therefore, the image-forming process of this invention is very useful.

The image-forming process of this invention having the foregoing features can be used not only for photographic field but also for the transfer of so-called soft image into a hard image. Moreover, since the dye image formed is fixed in a dye-fixing layer, the image has good preservative stability and the process of this invention can be easily utilized in the case of requiring the preservation of dye images for a long period of time. Thus, the invention exceed conventional photographic techniques and hence the significance of this invention is large.

Then, the invention will further be explained by the following examples but the invention shall not be restricted by these examples. (% in Examples except those to show saponification degree is shown based on weight).

EMULSION PREPARATION EXAMPLE-1

Preparation of silver iodobromide emulsion

In 3,000 ml of water were dissolved 40 g of gelatin and 26 g of potassium bromide and after stirring the solution at 50° C., a solution of 34 g of silver nitrate dissolved in 200 ml of water was added to the solution over a period of 10 minutes. Then, a solution of 3.3 g of potassium iodide dissolved in 100 ml of water was added to the mixture over a period of 2 minutes.

Then, the pH of the silver iodobromide emulsion thus formed was adjusted to sediment the emulsion and after removing excessive salts, the pH of the emulsion was adjusted to 6.0 to provide 400 g of a silver iodobromide emulsion.

EMULSION PREPARATION EXAMPLE-2

Preparation of benzotriazole silver salt emulsion

In 3,000 ml of water were dissolved 28 g of gelatin and 13.2 g of benzotriazole and after stirring the solution at 40° C., a solution of 17 g of silver nitrate dissolved in 100 ml of water was added to the solution over a period of 2 minutes.

The pH of the benzotriazole silver salt emulsion was adjusted to sediment the emulsion and after removing excessive salts, the pH of the emulsion was adjusted to 6.0 to provide 400 g of a benzotriazole silver salt emulsion.

EMULSION PREPARATION EXAMPLE-3

Preparation of benzotriazole silver salt emulsion containing light-sensitive silver bromide In 1,000 ml of water were dissolved 6.5 g of benzotriazole and 10 g of gelatin and after stirring the solution at 50° C., a solution of 8.5 g of silver nitrate dissolved in 100 ml of water was added to the solution over a period of 2 minutes.

Then, a solution of 1.2 g of potassium bromide dissolved in 50 ml of water was added to the mixture over a period of 2 minutes. The pH of the emulsion thus prepared was adjusted to settle the emulsion and after removing excessive salts, the pH of the emulsion was adjusted to 6.0. The yield was 200 g.

DYE-FIXING MATERIAL PREPARATION EXAMPLE-1

Preparation of Dye-fixing material R-1

In 200 ml of water was dissolved 10 g of methyl acrylate-N,N,N-trimethyl-N-vinylbenzylammonium chloride copolymer (the molar ratio of methyl acrylate and vinylbenzylammonium chloride being 1:1) and the solution was uniformly mixed with 100 g of a 10 wt % solution of limed gelatin. The mixture was uniformly coated on a polyethylene terephthalate film at a wet thickness of 20 μm.

Then, a solution prepared by mixing the following components (a) to (e) was uniformly coated on the foregoing layer at a wet thickness of 60 μm followed by drying to form a dye transfer assistant layer.

| | |
|---|---|
| (a) Urea [thermal solvent (1)] | 4 g |
| (b) Water | 8 ml |
| (c) Polyvinyl alcohol (saponification value of 98%) (10 wt % aq. solution) | 12 g |
| (d) 5 wt % Aqueous solution of compound having the following formula | 2 ml |
| (e) Sodium dodecylbenzenesulfonate (5% aq. soln.) | 0.5 ml |

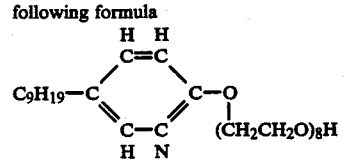

LIGHT-SENSITIVE MATERIAL PREPARATION EXAMPLE-1

Preparation of light-sensitive material E-1

Preparation of dispersion of reducible dye-releasing compound:

To a mixture of 5 g of the reducible dye-releasing compound (8), 4 g of the electron donor ED-(1), 0.5 g of succinic acid 2-ethylhexyl ester sodium sulfonate, and 10 g of tricresyl phosphate (TCP) was added 20 ml of cyclohexanone and the components were dissolved by heating to 60° C. After mixing the solution with 100 g of a 10 wt % aqueous solution of gelatin followed by stirring, the mixture was dispersed for 10 minutes by a homogenizer at 10,000 r.p.m. to provide a dispersion DP-1 of reducible dye-releasing compound.

Then, the preparation method for a light-sensitive coated material is explained.

| | | |
|---|---|---|
| (a) | Light-sensitive silver iodobromide emulsion (Emulsion preparation example - 1) | 25 g |
| (b) | Reducible dye-releasing compound dispersion DP-1 | 33 g |
| (c) | 10 wt % Ethanol solution of guanidine trichloroacetate | 15 ml |
| (d) | 2.5 wt % Aqueous solution of the compound of the formula 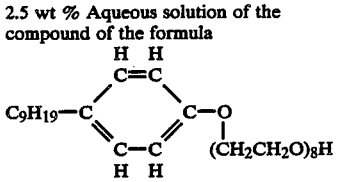 | 10 ml |
| (e) | 10 wt % Aqueous solution of N,N-dimethylsulfonamide | 4 ml |

To a mixture of above components (a) to (e) was added 2 ml of water and the components were mixed and dissolved by heating. The solution was coated on a polyethylene terephthalate film at a wet thickness of 60 μm and dried.

Furthermore, a coating liquid having the following composition was coated on the layer to provide a protective layer.

| | | |
|---|---|---|
| (f) | 10 wt % Aqueous solution of gelatin | 35 g |
| (g) | 10 wt % Ethanol solution of guanidine trichloroacetate | 6 ml |
| (h) | 1 wt % Aqueous solution of succinic acid 2-ethylhexyl ester-sodium sulfonate | 4 ml |
| (i) | Water | 55 ml |

That is, the coating liquid was coated on the foregoing layer at a wet thickness of 25 μm and dried to provide a light-sensitive material E-1.

EXAMPLE 1

The light-sensitive material E-1 prepared in Light-sensitive material preparation example-1 was imagewise exposed for 10 sec. at 2,000 lux using a tungsten lamp and then uniformly heated on a heat block heated to 130° C. for 30 seconds.

Then, the light-sensitive material was superposed on the dye-fixing material R-1 prepared in Dye-fixing material preparation example-1 with the coated layers of them in face-to-face relationship and they were uniformly heated for 30 seconds on a heat block heated to 120° C. By peeling off the dye-fixing material from the light-sensitive material, a positive magenta image was obtained on the dye-fixing material. When the density of the positive image was measured using Macbeth transmission densitometer, the maximum density to green light was 1.55 and the minimum density was 0.37. Also, the gradation of the sensitometry curve was 1.06 in density different to the exposure amount difference of 10 times at the straight portion.

From the foregoing result, it was confirmed that by using the dye-fixing material containing a heat solvent, a positive dye image having a large density difference between the maximum density and the minimum density can be obtained without supplying solvent.

EXAMPLE 2

Light-sensitive material E-2 was prepared by the same procedure as in Light-sensitive preparation example-1 except that 5 g of reducible dye-releasing compound (9) was used in place of reducible dye-releasing compound (8).

Then, dye-fixing materials R-2 to R-6 were prepared by the same manner as the case of preparing dye-fixing material R-1 except that the dye transfer agents shown in Table 1 were used in place of urea used on Dye-fixing material preparation example-1.

The image exposure, heating, and density measurement of the positive image were performed by the same manners as in Example 1 except that light-sensitive material E-2 was used in place of light-sensitive material E-1 and dye-fixing materials R-2 to R-6 were used in place of dye-fixing material R-1. The results are shown in Table 1.

TABLE 1

| Dye-fixing material | Thermal solvent | Maximum density | Minimum density |
|---|---|---|---|
| R-2 | N-Methylurea (4 g) | 1.50 | 0.35 |
| R-3 | Pyridine-N-oxide (4 g) | 1.44 | 0.32 |
| R-4 | Sulfonamide (4 g) | 1.61 | 0.39 |
| R-5 | Urea/N-methylurea (2g/2g/) | 1.58 | 0.34 |
| R-6 | Urea/N-methylurea/ethylene-urea/ethylurea (1g/1g/1g/1g) | 1.60 | 0.40 |

From the above results, it was confirmed that by using a dye-fixing material containing a thermal solvent, positive dye images having a large density difference between the maximum density and the minimum density are obtained without supplying any solvent. Also, when a dye-fixing material (R-5 and R-6) containing two or more kinds of a thermal solvent are used, particularly clear images having excellent surface gloss are obtained.

EXAMPLE 3

Light-sensitive materials E-3 to E-5 were prepared by the same manner as in Light-sensitive material preparation example-1 except that 5 g of each of the quinone compound of reducing dye-releasing compound (10), reducing dye-releasing compound (11), and the quinone compound of reducing dye-releasing compound (12) in place of reducing dye-releasing compound (8) is used and also 20 g of silver iodobromide emulsion and 10 g of benzotriazole silver salt emulsion (Emulsion preparation example-2) were used in place of 25 g of the silver iodobromide emulsion.

The image exposure, heating, and density measurement of the positive images were performed by the same manners as in Example-1 except that light-sensitive materials E-3 to E-5 were used in place of light-sensitive material E-1. The results are shown in Table 2.

TABLE 2

| Light-sensitive material | Dye-releasing material | Color | Maximum density | Minimum density |
|---|---|---|---|---|
| E-3 | Quinone compound of (10) | yellow | 1.23 | 0.28 |
| E-4 | (11) | magenta | 1.47 | 0.30 |
| E-5 | Quinone compound of (12) | cyan | 1.58 | 0.32 |

From the above results, it was confirmed that in the case of using the reducible dye-releasing compounds shown in Table 2, by using the dye-fixing materials containing a thermal heat solvent, positive dye images of cyan, magenta, and yellow can be obtained without supplying water.

EXAMPLE 4

Light-sensitive material E-6 was prepared by the same manner as in Light-sensitive material preparation example-1 except that 25 g of benzotriazole silver salt emulsion containing silver bromide (Emulsion preparation example-3) was used in place of 25 g of the silver iodobromide emulsion used in Light-sensitive material preparation example-1.

Then, the image exposure, heating and density measurement were performed by the same manners as in Example 1 except that light-sensitive material E-6 was used in place of light-sensitive material E-1. The maximum density of the positive magenta image formed on the dye-fixing material was 1.68 and the minimum density was 0.35.

EXAMPLE 5

The same procedure and processing as in Example 1 except that 0.4 g of 1-phenyl-4-methyl-4-oxymethyl-3-pyrazolidone was added to the coating liquid for the light-sensitive material in Light-sensitive material preparation example-1 as an electron transfer agent. The maximum density of the magenta image thus obtained was 1.60 and the minimum density was 0.29. Thus, it was confirmed that the addition of the electron transfer agent contributes to the improvement of the image quality.

EXAMPLE 6

Light-sensitive materials E-7 to E-9 were prepared by the same manner as in Light-sensitive material preparation example-1 except that the amount of guanidine trichloroacetate used in Light-sensitive material preparation example-1 was reduced to ½ and 5 g of reducible dye-releasing compound (16), was used in place of reducible dye-releasing compound (8), and further electron donor ED-(2) (4 g), ED-(3) (4 g), or ED-(4) (4 g) was used in place of electron donor ED-(1).

Also, dye-fixing material R-7 was prepared by following the same procedure as in Dye-fixing material preparation example-1 except that 0.4 g of guanidine trichloroacetate was added to the coating liquid used in Dye-fixing material preparation of example-1.

After imagewise exposing each of light-sensitive materials E-7 to E-9 for 10 seconds at 2,000 lux using a tungsten lamp, the light-sensitive material was superposed on dye-fixing material R-7 with the coated layers in face-to-face relation and they were heated for 45 seconds on a heat block heated to 130° C.

When the dye-fixing material was peeled off from the light-sensitive material, a positive color image was obtained on the dye-fixing material. The densities of these positive color images thus formed were measured using a Macbeth densitometer. The results are shown in Table 3.

TABLE 3

| Light-sensitive material | Electron donor | Maximum density | Minimum density |
|---|---|---|---|
| E-7 | ED - (1) | 1.22 | 0.28 |
| E-8 | ED - (3) | 1.39 | 0.31 |
| E-9 | ED - (4) | 1.51 | 0.25 |

From the above results, it was confirmed that even if the heat development and dye transfer are simultaneously performed, a positive dye image having the high maximum density and the low minimum density can be obtained.

LIGHT-SENSITIVE MATERIAL PREPARATION EXAMPLE-2

Preparation of light-sensitive material E-10

Preparation of dispersion of dye-releasing compound:

To a mixture of 5 g of the dye-releasing compound (13), 0.5 g of succinic acid 2-ethylhexyl ester sodium sulfonate, and 15 g of tricresyl phosphate (TCP) was added 30 ml of ethylacetate and the components were dissolved by heating to 60° C. After mixing the solution with 100 g of a 10 wt % aqueous solution of gelatin followed by stirring, the mixture was dispersed for 10 minutes by a homogenizer at 10,000 r.p.m. to provide a dispersion DP-2 of dye-releasing compound.

Then, the preparation method for a light-sensitive coated material is explained.

| | | |
|---|---|---|
| (a) | Light-sensitive silver iodobromide emulsion (Emulsion preparation example - 1) | 25 g |
| (b) | Dye-releasing compound dispersion DP-2 | 33 g |
| (c) | 10 wt % Ethanol solution of guanidine trichloroacetate | 15 ml |
| (d) | 2.5 wt % Aqueous solution of the compound of the formula 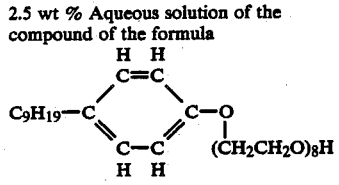 | 10 ml |
| (e) | 10 wt % Aqueous solution of 10% N,N-dimethylsulfonamide | 4 ml |

After mixing and dissolving components (a) to (e) the solution was coated on a polyethylene terephthalate film at a wet thickness of 30 μm and dried.

Furthermore, a coating liquid having the following composition was coated on the layer as a protective layer.

| | | |
|---|---|---|
| (f) | 10 wt % Aqueous solution of gelatin | 35 g |
| (g) | 10 wt % Ethanol solution of guanidine trichloroacetate | 6 ml |
| (h) | 1 wt % Aqueous solution of succinic acid 2-ethylhexyl ester-sodium sul- | 4 ml |

-continued

| | | |
|---|---|---|
| | fonate | |
| (i) | Water | 55 ml |

That is, the coating liquid was coated on the foregoing layer at a wet thickness of 25 μm and dried to provide a light-sensitive material E-10.

EXAMPLE 7

The light-sensitive material E-10 prepared in Light-sensitive material preparation example-2 was imagewise exposed for 10 sec. at 2,000 lux using a tungsten lamp and then uniformly heated on a heat block heated to 130° C. for 30 seconds.

Then, the light-sensitive material was superposed on the dye-fixing material R-1 prepared in Dye-fixing material preparation example-1 with the coated layers of them in face-to-face relationship and they were uniformly heated for 30 seconds on a heat block heated to 120° C. By peeling off the dye-fixing material from the light-sensitive material, a positive magenta image was obtained on the dye-fixing material. When the density of the positive image was measured using Macbeth transmission densitometer, the maximum density to green light was 1.63 and the minimum density was 0.52. Also, the gradation of the sensitometry curve was 1.07 in density different to the exposure amount difference of 10 times at the straight portion.

EXAMPLE 8

Light-sensitive material E-11 was produced in the same procedure as in Light-sensitive material preparation example-2 except that 0.4 g of 1-phenyl-4-methyl-4-oxymethyl-3-pyrazolidone was added to the coating liquid for the light-sensitive material in Light-sensitive material example-2 as an electron transfer agent.

Then, dye-fixing materials R-8 to R-12 were prepared by the same manner as the case of preparing dye-fixing material R-1 except that the dye transfer agents shown in Table 4 were used in place of urea used on Dye-fixing material preparation example-1.

The image exposure, heating, and density measurement of the positive image were performed by the same manner as in Example 7 except that light-sensitive material E-11 was used in place of light-sensitive material E-10 and dye-fixing materials R-8 to R-12 were used in place of dye-fixing material R-1. The results are shown in Table 4.

TABLE 4

| Dye-fixing material | Dye transfer agent | Maximum density | Minimum density |
|---|---|---|---|
| R-8 | N-Methylurea (4g) | 1.65 | 0.58 |
| R-9 | Pyridine-N-oxide (4g) | 1.68 | 0.53 |
| R-10 | Sulfonamide (4g) | 1.69 | 0.50 |
| R-11 | Urea/N-methylurea (2g/2g) | 1.59 | 0.56 |
| R-12 | Urea/N-methylurea/ethylene urea/ethylurea (1g/1g/1g/1g) | 1.63 | 0.61 |

Example 9

Light-sensitive materials E-12 was prepared by the same manner as in Light-sensitive material preparation example-2 except that 5 g of dye-releasing compound (14) in place of the dye-releasing compound (13) and also 20 g of silver iodobromide emulsion and 10 g of benzotriazole silver salt emulsion (Emulsion preparation example-2) were used in place of 25 g of the silver iodobromide emulsion.

The image exposure, heating, and density measurement of the positive images were performed by the same manners as in Example-7 except that light-sensitive material E-12 was used in place of light-sensitive material E-10. The maximum density of the image was 1.43 and the minimum density was 0.59.

EXAMPLE 10

Light-sensitive material E-13 was prepared by the same manner as in Light-sensitive material preparation example-2 except that 25 g of benzotriazole silver salt emulsion containing silver bromide (Emulsion preparation example-3) was used in place of 25 g of the silver iodobromide emulsion used in Light-sensitive material preparation example-2.

Then, the image exposure, heating and density measurement were performed by the same manners as in Example 7 except that light-sensitive material E-13 was used in place of light-sensitive material E-10. The maximum density of the positive magenta image formed on the dye-fixing material was 1.49 and the minimum density was 0.50.

EXAMPLE 11

Light-sensitive material E-14 was prepared by the same manner as in Light-sensitive material preparation example-2 except that guanidine trichloroacetate used in Light-sensitive material preparation example-2 was deleted.

Also, dye-fixing material R-13 was prepared by following the same procedure as in Dye-fixing material preparation example-1 except that 0.8 g of guanidine trichloroacetate was added to the coating liquid used in Dye-fixing material preparation example 1.

After imagewise exposing light-sensitive material E-14 for 10 seconds at 2,000 lux using a tungsten lamp, the light-sensitive material was superposed on dye-fixing material R-13 with the coated layers in face-to-face relation and they were heated for 45 seconds on a heat block heated to 130° C.

When the dye-fixing material was peeled off from the light-sensitive material, a positive color image was obtained on the dye-fixing material. The densities of these positive color images thus formed were measured using a Macbeth densitometer. The maximum density of the image was 1.38 and the minimum density was 0.43.

LIGHT-SENSITIVE MATERIAL AND PREPARATION EXAMPLE-3

Preparation of light-sensitive material E-15

Preparation of dispersion (DP-3) of dye-releasing compound:

To a mixture of 10 g of the dye-releasing compound (5), 0.5 g of succinic acid 2-ethylhexyl ester sodium sulfonate as a surfactant, and 10 g of tricresyl phosphate (TCP) was added 20 ml of cyclohexanone and the components were dissolved by heating to 60° C. to obtain a solution. After mixing the solution with 100 g of 10% aqueous solution of gelatin followed by stirring, the mixture was dispersed for 10 minutes by a homogenizer at 10,000 r.p.m. to provide a dispersion DP-3 of dye-releasing compound.

Light-sensitive material E-15 was prepared as follows:

| | |
|---|---|
| (a) Light-sensitive silver iodobromide emulsion (Emulsion preparation example - 1) | 2 g |
| (b) Benzotriazole silver salt emulsion (Emulsion preparation example - 2) | 5 g |
| (c) 10 wt % Aqueous solution of gelatin | 2 g |
| (d) Dye-releasing compound (5) dispersion DP-3 | 2.5 g |
| (e) 10 wt % Ethanol solution of guanidine trichloroacetate | 0.5 ml |
| (f) 10 wt % Methanol solution of 2,6-dichloro-4-aminophenol | 0.5 ml |
| (g) 5 wt % Aqueous solution of the compound of the formula 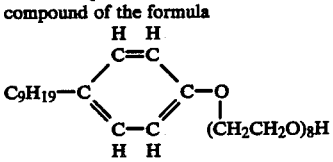 | 1 ml |
| (h) Water | 4.5 ml |

Above components (a) to (h) were mixed and dissolved by heating. The solution was coated on a polyethylene terephthalate film having a thickness of 180 μm at a wet thickness of 85 μm and dried.

Furthermore, a gelatin layer was coated in an amount of 1.5 g/m$^2$ on the layer as a protective layer to obtain a light-sensitive material E-15.

LIGHT-SENSITIVE MATERIAL PREPARATION EXAMPLE-4

Preparation of light-sensitive material E-16:

A gelatin dispersion (DP-4) of dye-releasing compound (7) was prepared in the same manner as in light-sensitive material preparation example-3 except that dye-releasing compound (7) was used in place of dye-releasing compound (5).

Then, light-sensitive coated material E-16 was prepared in the following manner.

| | |
|---|---|
| (a) Light-sensitive silver iodobromide emulsion (Emulsion preparation example - 1) | 5.5 g |
| (b) 10 wt % Aqueous solution of gelatin | 2 g |
| (c) Dye-releasing compound dispersion DP-4 | 2.5 g |
| (d) 10 wt % Ethanol solution of guanidine trichloroacetate | 0.5 ml |
| (e) 10 wt % Methanol solution of 2,6-dichloro-4-aminophenol | 0.5 ml |
| (f) 5 wt % Aqueous solution of the compound of the formula 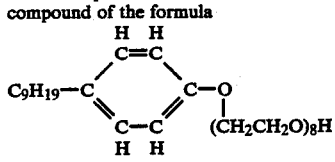 | 1 ml |
| (g) Water | 6 ml |

Above components (a) to (g) were mixed and dissolved by heating. the solution was coated on a polyethylene terephthalate film having a thickness of 180 μm at a wet thickness of 85 μm and dried.

Furthermore, gelatin was coated on the layer in an amount of 1.5 g/m$^2$ as a protective layer to provide light-sensitive material E-16.

LIGHT-SENSITIVE MATERIAL PREPARATION EXAMPLE-5

Preparation of light-sensitive material E-17

Light-sensitive material E-17 was prepared in the same manner as in light-sensitive material preparation example-4 except that 5.5 g of the benzotriazole silver salt emulsion containing light-sensitive silver bromide obtained in Emulsion preparation example-3 was used in place of the silver iodobromide emulsion, and dye-releasing compound (6) shown below was used in place of dye-releasing compound (7).

LIGHT-SENSITIVE MATERIAL PREPARATION EXAMPLE-6

Preparation of light-sensitive materials E-18-20

Light-sensitive materials E-18-20 were prepared in the same manner as in Light-sensitive material preparaton examples-3 to 5 except that 2,6-dichloro-4-aminophenol was not used in the light-sensitive materials, respectively.

DYE-FIXING MATERIAL PREPARATION EXAMPLE-2

Preparation of Dye-fixing material R-14

In 200 ml of water was dissolved 10 g of methyl acrylate-N,N,N-trimethyl-N-vinylbenzylammonium chloride copolymer (the molar ratio of methyl acerylate and vinylbenzylammonium chloride being 1:1) and the solution was uniformly mixed with 100 g of a 10 wt % solution of limed gelatin. The mixture was uniformly coated on a polyethylene terephthalate film at a wet thickness of 90 μm.

Then, a solution prepared by mixing the following components (a) to (e) was uniformly coated on the foregoing layer at a wet thickness of 60 μm followed by drying to form a hydrophobic heat solvent layer.

| | |
|---|---|
| (a) Urea | 4 g |
| (b) Water | 10 ml |
| (c) Polyvinyl alcohol (saponification value of 98%) (10 wt % aq. solution) | 12 g |
| (d) Compound having the following formula 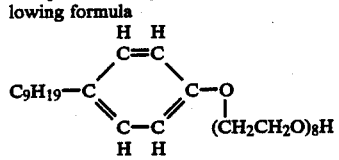 | 100 mg |
| (e) Sodium dodecylbenzenesulfonate (5 wt % aqueous solution) | 0.5 ml |

DYE-FIXING MATERIAL PREPARATION EXAMPLE-3

Dye-fixing materials R-15 to R-17 were prepared in the same manner as in Dye-fixing material preparation example-3 except that 4 g of pyridine-4-oxide, sulfone amide or acetamide was used in place of 4 g of urea.

DYE-FIXING MATERIAL PREPARATION EXAMPLE-4

Dye-fixing material R-18 was prepared in the same manner as Dye-fixing material preparation example-2 except that 2 g of urea and 2 g of methylurea were mixed and used in place of 4 g of urea.

In the same manner as above Dye-fixing material R-19 was prepared using 1 g of urea, 1 g of methylurea, 1 g of ethylurea and 1 g of ethyleneurea were mixed and used.

DYE-FIXING MATERIAL PREPARATION EXAMPLE-3

Dye-fixing materials R-20 and 21 were prepared in the same manner as in Dye-fixing material preparation examples-2 and 4 except that 5 ml of a 10 wt % methanol solution of 2,6-dichloro-4-aminophenol was added into the hydrophilic thermal solvent coating liquids used in the preparation of dye-fixing material R-14 in the example 2 and dye-fixing material R-18 in the example 4.

EXAMPLE 12

The light-sensitive material E-15 was imagewise exposed for 10 sec. at 2,000 lux using a tungsten lamp and then uniformly heated on a heat block heated to 140° C. for 40 seconds.

Then, each light-sensitive material was superposed on each dye-fixing materials R-14 to 19 with the coated layers of them in face-to-face relationship and they were uniformly heated for 30 seconds on a heat block heated to 120° C. By peeling off the dye-fixing material from the light-sensitive material, a negative magenta image was obtained on the dye-fixing material. The density of the negative image was measured using Macbeth transmission densitometer, and the results are shown in Table 5.

TABLE 5

| Dye-fixing material | Dye transfer agent | Maximum density | Minimum density |
|---|---|---|---|
| R-14 | Urea | 1.33 | 0.15 |
| R-15 | Pyridine-N-oxide | 1.38 | 0.18 |
| R-16 | Sulfone amide | 1.18 | 0.12 |
| R-17 | Acetamide | 1.10 | 0.09 |
| R-18 | Urea/N-methylurea | 1.29 | 0.14 |
| R-19 | Urea/N-methylurea/ethylene-urea/ethylurea | 1.35 | 0.17 |

From the above results, it was confirmed that by using a dye-fixing material containing a thermal solvent, dye images having a high maximum density can be obtained without supplying water. Also, when dye-fixing materials (R-18 and R-19) containing two or more kinds of the hydrophilic heat solvents were used, particularly clear images having excellent surface gloss can be obtained.

EXAMPLE 13

Light-sensitive materials E-15 to 17 were exposed and heat developed in the same manner as in Example 12. Each light sensitive material was superposed on Dye-fixing material R-14 with the coated layers in face-to-face relation and they were heated for 30 seconds on a heat block heated to 120° C.

When the dye-fixing material was peeled off from the light-sensitive material, negative magenta, cyan and yellow images were obtained on each dye-fixing material. The densities of these negative images thus formed were measured using a Macbeth densitometer. The results are shown in Table 6.

TABLE 6

| Light-sensitive material | Dye-releasing compound | Color | Maximum density | Minimum density |
|---|---|---|---|---|
| E-15 | (5) | Magenta | 1.33 | 0.15 |
| E-16 | (7) | Cyan | 1.58 | 0.21 |
| E-17 | (6) | Yellow | 1.10 | 0.13 |

EXAMPLE 14

After imagewise exposing each of light-sensitive materials E-18 to E-20 for 10 seconds at 2,000 lux using a tungsten lamp, the light-sensitive material was superposed on dye-fixing material R-20 or R-21 with the coated layers in face-to-face relation and they were heated for 30 seconds on a heat block heated to 130° C.

When the dye-fixing material was peeled off from the light-sensitive material, negative magenta, cyan and yellow images corresponding to each high-sensitive material were obtained on the dye-fixing material. The densities of these negative images thus formed were measured using a Macbeth densitometer. The results are shown in Table 7.

TABLE 7

| Light-sensitive material | Dye-fixing material | Maximum density | Minimum density |
|---|---|---|---|
| E-18 | R-20 | 1.18 | 0.16 |
| E-19 | R-20 | 1.20 | 0.18 |
| E-20 | R-20 | 1.00 | 0.15 |
| E-18 | R-21 | 1.12 | 0.20 |
| E-19 | R-21 | 1.15 | 0.17 |
| E-20 | R-21 | 1.01 | 0.13 |

From the above results, it was confirmed that even if the heat development and dye transfer are simultaneously performed, a dye image having the high maximum density can be obtained.

EXAMPLE 15

Light-sensitive material E-21 was prepared in the same manner as in Light-sensitive preparation example -3 except that 1.5 g of urea as a thermal solvent (1) was added to the coating liquid for the light-sensitive material E-15.

Then, dye-fixing material R-22 was prepared in the same manner as in Dye-fixing material preparation example -2 except that the coating amount of urea of the heat solvent layer was deleted to a half.

The light-sensitive material E-21 was imagewise exposed for 10 sec. at 2,000 lux using a tungsten lamp and then uniformly heated on a heat block heated to 130° C. for 20 seconds.

Then, the light-sensitive material was superposed on the dye-fixing material R-22 with the coated layers of them in face-to-face relationship and they were uniformly heated for 20 seconds on a heat block heated to 120° C. By peeling off the dye-fixing material from the light-sensitive material, a negative magenta image was obtained on the dye-fixing material. When the density of the positive image was measured using Macbeth transmission densitometer, the maximum density to green light was 1.37 and the minimum density was 0.22.

From the foregoing result, it was confirmed that by incorporating a thermal solvent into a light-sensitive material a dye image having a high maximum density can be obtained in a short heating time without supplying water.

DYE-FIXING MATERIAL PREPARATION EXAMPLE -6

Dye-fixing Material R-23 was Prepared as Follows

In 200 ml of water were dissolved 10 g of methyl acrylate-N,N,N-trimethyl-N-vinylbenzylammonium chloride copolymer (the molar ratio of methyl acrylate and vinylbenzylammonium chloride being 1:1) and 25 g of urea as a heat solvent, and the solution was uniformly mixed with 100 g of a 10 wt % solution of limed gelatin. The mixture was uniformly coated on a polyethylene terephthalate film at a wet thickness of 90 μm.

A polyvinyl alcohol was coated on the thus formed layer in a dry thickness of 1.5 μm to provide Dye-fixing material R-23.

EXAMPLE 16

The light-sensitive material E-15 was imagewise exposed for 10 sec. at 2,000 lux using a tungsten lamp and then uniformly heated on a heat block heated to 140° C. for 20 seconds.

Then, the light-sensitive material was superposed on the dye-fixing material R-23 with the coated layers of them in face-to-face relationship and they were uniformly heated for 30 seconds on a heat block heated to 120° C. By peeling off the dye-fixing material from the light-sensitive material a negative magenta image was obtained on the dye-fixing material. When the density of the negative image was measured using Macbeth transmission densitometer, the maximum density was 1.29 and the minimum density was 0.18.

From the above results, it was confirmed that by using a dye-fixing material containing a thermal solvent, dye images having a high maximum density can be obtained without supplying water.

EXAMPLE 17

A mixture of 10 g of dye-releasing compound (15), 0.5 g of succinic acid 2-ethylhexyl ester-sodium sulfonate as a surface active agent, and 10 g of tricresyl phosphate was mixed with 20 ml of cyclohexanone and the resultant mixture was heated to 60° C. to provide a homogenous solution. The solution was mixed with 100 g of 10% aqueous solution of limed gelatin with stirring and then the mixture was treated in a homogenizer for 10 minutes at 10,000 r.p.m. to provide a dispersion of a magenta dye-releasing compound (DP-5).

Then, the preparation of a light-sensitive coating composition is explained.

Preparation of Light-sensitive Material E-22

| | |
|---|---|
| (a) Silver iodobromide emulsion (Emulsion preparation example - 1) | 2 g |
| (b) Benzotriazole silver salt emulsion (Emulsion preparation example - 2) | 5 g |
| (c) 10% Aqueous solution of gelatin | 2 g |
| (d) Gelatin dispersion (DP-5) of dye-releasing compound (15) | 12.5 g |
| (e) 15% Methanol solution of 2,6-dichloro-4-aminophenol | 10 ml |
| (f) 5% Aqueous solution of the compound having the following formula | 10 ml |

-continued

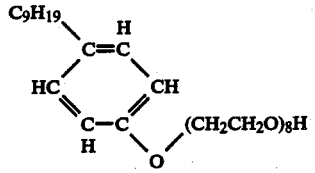

| | |
|---|---|
| (g) Water | 4.5 ml |

After mixing above components (a) to (g), the mixture was dissolved by heating and coated on a polyethylene terephthalate film of 180 μm in thickness at a wet thickness of 85 μm. Furthermore, a gelatin layer was formed at a coverate of 1.5 g/m$^2$ on the layer as a protective layer to provide light-sensitive material E-22.

Then, the formation of a dye-fixing material having a dye-fixing layer is explained.

In 200 ml of water was dissolved 10 g of methyl acrylate-N,N,N-trimethyl-N-vinylbenzyl ammonium chloride copolymer (the molar ratio of methyl acrylate and vinylbenzyl ammonium chloride was 1:1) and the solution was uniformaly mixed with 10% of 100 g of an aqueous solution of limed gelatin. The mixture was uniformly coated on a titanium dioxide-dispersed polyethylene terephthalate film of 120 μm in thickness at a wet thickness of 90 μm.

Then, after mixing and dissolving following components (a) to (f), the mixture was coated on the layer at a thickness of 70 μm and dried. The sample was used as a dye-fixing material (sheet A).

| [Solution A] | |
|---|---|
| (a) Urea | 2 g |
| (b) N-Methylurea | 2 g |
| (c) Water | 10 ml |
| (d) 10% Aqueous solution of polyvinyl alcohol (saponification degree of 98%) | 12 g |
| (e) Aqueous solution of the following compound 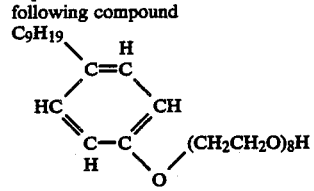 | 100 mg |
| (f) 5% Aqueous solution of sodium dodecylbenzenesulfonate | 0.5 ml |

Also, solution B was prepared by the same way as above except that 0.4 g of sodium carbonate was used as the base in foregoing solution A and a dye-fixing material (sheet B) was prepared by the same procedure as above using solution B.

Furthermore, solution C was prepared by the same way as above except that 0.8 g of guanidine trichloroacetate was used as the base precursor and a dye-fixing material (sheet C) was prepared by the same procedure as above using solution C.

The light-sensitive material E-22 was imagewise exposed for 10 seconds using a tungsten lamp at 2,000 lux. Then the material was closely superposed on the dye-fixing material, sheet A, B or C with both layers in face-to-face relationship, and they were heated on a heat block of 130° C. for 30 seconds.

By peeling off the dye-fixing material from the light-sensitive material, a negative magenta image was obtained on each dye-fixing material. The density of the negative image was measured using a Macbeth reflection densitometer.

The results are shown in Table 8.

TABLE 8

| Dye-fixing material | Maximum density | Minimum density |
|---|---|---|
| Sheet A (containing no base) | 0.25 | 0.15 |
| Sheet B (containing base) | 1.67 | 0.35 |
| Sheet C (containing base) | 1.63 | 0.37 |

By the above results, it has been confirmed that images having the high maximum density are obtained by using the dye-fixing materials containing a base.

EXAMPLE 18

Preparation of light-sensitive material E-23

Preparation of the emulsion of coupler [compound (4)].

To 100 g of a 10% aqueous solution of gelatin at 40° C. was added 0.5 g of sodium dodecylbenzenesulfonate followed by stirring to provide a solution. A mixture of 10 g of the non-diffusible coupler [compound (4)], 10 g tricresyl phosphate and 20 ml of ethyl acetate was heated to provide a homogenous solution. A mixture of the foregoing aqueous gelatin solution of the surface active agent and the solution of the coupler was treated by means of a homogenizer for 3 minutes at 12,000 r.p.m. to provide a coupler emulsion.

Light-sensitive material E-23 was prepared as follows:

| | | |
|---|---|---|
| (a) | Silver iodobromide emulsion (Emulsion preparation example - 1) | 5.5 g |
| (b) | 10% Aqueous solution of gelatin | 2 g |
| (c) | Dispersion of coupler | 2.5 g |
| (d) | 10% methanol solution of 2,6-dichloro-4-aminophenol | 0.5 ml |
| (e) | 5% Aqueous solution of the compound having the following structure | 1 ml |

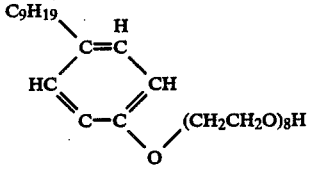

A mixture of above components (a) to (f) was heated to form a homogenous solution and the solution was coated on a polyethylene terephthalate film of 180 μm in thickness at a wet thickness of 85 μm. Furthermore, a gelatin solution was coated thereon at a coverage of 1.5 g/m$^2$ as a protective layer to provide light-sensitive material E-23

The foregoing light-sensitive material was imagewise exposed for 10 seconds using a tungsten lamp at 2,000 lux.

The light-sensitive material was closely superposed on the dye-fixing material, sheet A, B, or C as in Example 17 and they were heated for 30 seconds on a heat block heated at 130° C.

By peeling off the dye-fixing material from the light-sensitive material, a negative magenta image was obtained on the dye-fixing material.

The density of the negative image was measured using a Macbeth reflection densitometer. The results are shown in Table 9.

TABLE 9

| Dye-fixing material | Maximum density | Minimum density |
|---|---|---|
| Sheet A (containing no base) | 0.30 | 0.13 |
| Sheet B (containing base) | 1.72 | 0.36 |
| Sheet C (containing base) | 1.70 | 0.38 |

From the above results, it has been confirmed that images having the high maximum density are obtained by using the dye-fixing materials containing a base.

EXAMPLE 19

Preparation of Light-sensitive Material E-24

Preparation of dispersion of dye-releasing compound:

A mixture of 5 g of dye-releasing compound (13), 0.5 g of succinic acid 2-ethylhexyl ester-sodium sulfonate, and 15 g of tricresyl phosphate (TCP) was mixed with 30 ml of ethyl acetate and the resultant mixture was heated to 60° C. to provide a solution. The homogenous solution was mixed with 100 g of a 10% aqueous solution of limed gelatin with stirring and the mixture was treated in a homogenizer for 10 minutes at 10,000 r.p.m. to provide a dispersion DP-6 of dye-releasing compound.

Then, the preparation of a light-sensitive coating composition is explained.

| | | |
|---|---|---|
| (a) | Light-sensitive silver iodobromide emulsion (Emulsion preparation example - 1) | 25 g |
| (b) | Dispersion DP-6 of dye-releasing compound | 33 g |
| (c) | 2.5% Aqueous solution of the following compound | 10 ml |

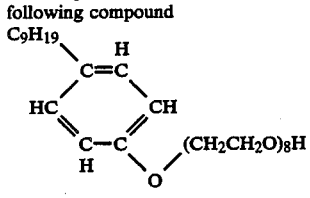

| | | |
|---|---|---|
| (d) | 10% Aqueous solution of gelatin | 4 ml |

A mixture of about components (a) to (d) was heated to form a solution and the solution was coated on a polyethylene terephthalate film at a wet thickness of 30 μm and dried. Then a mixture of the following components was further coated thereon as a protective layer.

| | | |
|---|---|---|
| (e) | 10% Aqueous solution of gelatin | 35 g |
| (f) | 10% Ethanol solution of guanidine trichloroacetate | 6 ml |
| (g) | 1% Aqueous solution of sodium sulfonate | 4 ml |
| (h) | Water | 55 ml |

The mixture of the above components was coated at wet thickness of 25 μm and dried to provide a light-sensitive material E-24.

The foregoing light-sensitive material E-24 was imagewise exposed for 10 seconds using a tungsten lamp at 2,000 lux.

Then, the light-sensitive material was superposed on the dye-fixing material, sheet A, B or C with the layers in face-to-face relationship and they were uniformly heated on a heat block heated at 130° C. for 30 seconds. By peeling off the dye-releasing material from the light-sensitive materials, a positive magenta image was obtained on each dye-fixing material. The density of the positive image was measured using a Macbeth reflection densitometer.

The results are shown in Table 10.

TABLE 10

| Dye-fixing material | Maximum density | Minimum density |
|---|---|---|
| Sheet A (containing no base) | 0.13 | 0.13 |
| Sheet B (containing base) | 1.65 | 0.42 |
| Sheet C (containing base) | 1.70 | 0.43 |

From the above results, it has been confirmed that images having the high maximum density are obtained by using the dye-fixing materials containing a base.

EXAMPLE 21

Preparation of Light-sensitive Material 25

A mixture of 5 g of foregoing dye-releasing compound (13), 4 g of electron donor ED- (1) 0.5 g of succinic acid 2-ethylhexyl estersodium sulfonate, and 10 g of tricresyl phosphate was mixed with 20 ml of cyclohexanone followed by heating to 60° C. to provide a solution. The solution was mixed with 100 g of a 10% aqueous solution of gelatin with stirring and the mixture was treated in a homogenizer for 10 minutes at 10,000 r.p.m. to provide dispersion DP-7 of dye-releasing compound.

Then, a light-sensitive coating composition was prepared as follows:

| | | |
|---|---|---|
| (a) | Light-sensitive silver iodobromide emulsion (Emulsion preparation example - 1) | 25 g |
| (b) | Dispersion DP-7 of dye-releasing emulsion | 33 g |
| (c) | 2.5% Aqueous solution of the following compound 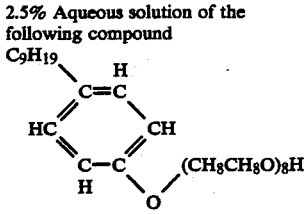 | 10 ml |
| (d) | 10% Aqueous solution of N,N-dimethylsulfonamide | 4 ml |

To a mixture of above components (a) to (d) was added 2 ml of water followed by mixture, the mixture was heated to form a solution, and the solution was coated on a polyethylene terephthalate film at a wet thickness of 60 μm followed by drying.

Furthermore, the following composition was coated thereon as a protective layer.

| | | |
|---|---|---|
| (a) | 10% Aqueous solution of gelatin | 35 g |
| (b) | 10% Ethanol solution of guanidine trichloroacetate | 6 ml |
| (c) | 1% Aqueous solution of succinic acid 2-ethylhexyl ester-sodium sulfonate | 4 ml |
| (d) | Water | 55 ml |

The mixture of above components was coated at a wet thickness of 25 μm and dried to provide light-sensitive material E-25.

The foregoing light-sensitive material E-25 was imagewise exposed for 10 seconds using a tungsten lamp at 2,000 lux.

Then, the light-sensitive material was closely superposed on the dye-fixing material, sheet A, B or C with the layers in face-to-face relationship and they were heated on a heat block heated at 130° C. for 30 seconds.

By peeling off the dye-fixing material from the light-sensitive material, a positive magenta image was obtained on the dye-fixing material. The density of the positive image was measured using a Macbeth reflection densitometer and the results are shown in Table 11.

TABLE 11

| Dye-fixing material | Maximum density | Minimum density |
|---|---|---|
| Sheet A (containing no base) | 0.14 | 0.13 |
| Sheet B (containing base) | 1.82 | 0.40 |
| Sheet C (containing base) | 1.79 | 0.41 |

From the above results, it has been confirmed that images having the high maximum density can be obtained by using the dye-fixing materials containing a base.

What is claimed is:

1. A dry image-forming process which comprises image-wise exposing a light-sensitive silver halide material to radiation and transferring a dye imagewise formed as a consequence of the image-wise exposing, wherein the silver halide light-sensitive material comprises a support having thereon a light-sensitive silver halide, a binder and a dye-forming compound which forms the dye in a chemical reaction of the dye-forming compound upon a reduction reaction of the exposed silver halide to silver by heat development of the light-sensitive material into a dye-fixing layer of a dye-fixing material having a mordant and a thermal solvent in an amount of 20 to 200% by weight of the total coating amount for the light-sensitive material and the dye-fixing material at high temperature at which the thermal solvent is in a molten state, wherein said dye-fixing material contains at least one of a base and a base precursor.

2. A dry image-forming process as claimed in claim 1, wherein said dye is one selected from the group consisting of azo dyes, azomethine dyes, anthraquinone dyes, naphthoquinone dyes, styryl dyes, nitro dyes, quinoline dyes, carbonyl dyes and phthalocyanine dyes.

3. A dry image-forming process as claimed in claim 1, wherein said thermal solvent has a melting point of 40° to 250° C.

4. A dry image-forming process as claimed in claim 1, wherein said thermal solvent acts as a solvent of the dye at a fixing-temperature at which the solvent melts.

5. A dry image-forming process as claimed in claim 1, wherein the thermal solvent has a molecular weight of less than 200.

6. A dry image-forming process as claimed in claim 1, wherein the thermal solvent is selected from the group consisting of ureas, pyridines, amides, sulfonamides, imides, alcohols, oximes, and heterocyclic compounds.

7. A dry image-forming process as claimed in claim 1, wherein said thermal solvent is selected from the group consisting of;

(1) $H_2N\overset{O}{\overset{\|}{C}}NH_2$, (2) $H_2N\overset{O}{\overset{\|}{C}}NHCH_3$ (3) $H_2N\overset{O}{\overset{\|}{C}}NHC_2H_5$, (4) $CH_3NH\overset{O}{\overset{\|}{C}}NHCH_3$ (5) $HOCH_2NH\overset{O}{\overset{\|}{C}}NH_2$ (6) $HOCH_2NH\overset{O}{\overset{\|}{C}}NHCH_2OH$ (7) $HOC_2H_4NH\overset{O}{\overset{\|}{C}}NHC_2H_4OH$ (8) $H_2N\overset{O}{\overset{\|}{C}}NHC_2H_4OH$ (9) $H_2N\overset{O}{\overset{\|}{C}}N(C_2H_4OH)_2$ (10)

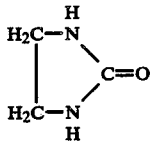

(11)

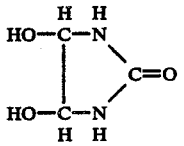

(12) $H_2N-\overset{O}{\overset{\|}{C}}-N(CH_3)_2$ (13)

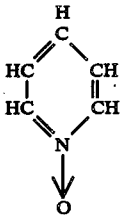

-continued (14)

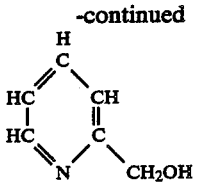

(15)

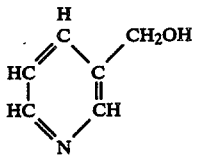

(16)

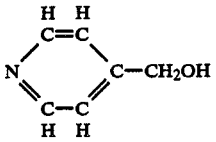

(17)

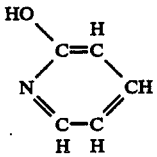

(18)

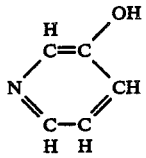

(19)

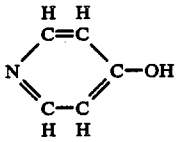

(20)

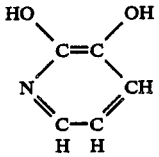

(21)

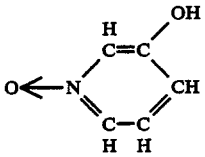

(22)

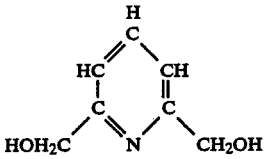

(23)

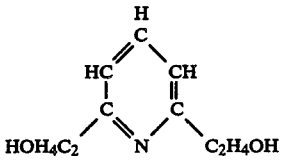

-continued
(24)
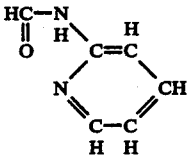
(25)
$(HC(=O)NH)_2CH_2$,
(26)
$CH_3C(=O)NH_2$
(27)
$(CH_3C(=O)NH)_2CH_2$,
(28)
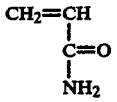
(29)
$HOC_2H_4C(=O)NH_2$,
(30)
$HOCH_2C(=O)NH_2$
(31)
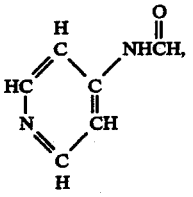
(32)
$NCCH_2C(=O)NH_2$
(33)
$(CH_3)CH(OH)-C(=O)-NH_2$
$CH_3SO_2NH_2$, (34)
$HOCH_2SO_2NH_2$ (35)
$H_2NSO_2NH_2$, (36)
$_3HCNHSO_2NH_2$ (37)
$HOCH_2SO_2$ , (38)
|
$NHCH_3$
$(CH_3)_2N$ (39)
|
$SO_2NH_2$
(40)
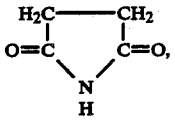
(41)
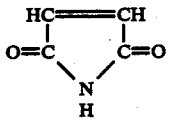
-continued
(42)
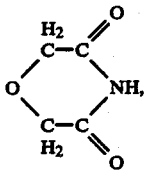
(43)
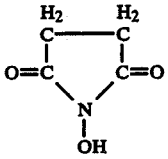
(44)
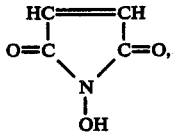
$(CH_3CO)_2NH$ (45)
(46)
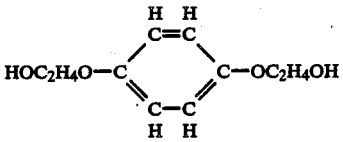
$HOCH_2(CHOH)_3CH_2OH$ (47)
$CH_3C(CH_2OH)_3$, (48)
$C_2H_5C(CH_2OH)_3$ (49)
$O_2NC(CH_2OH)_3$, (50)
SORBITOL (51)
(52)
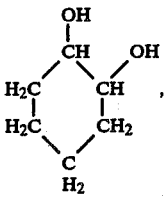
(53)
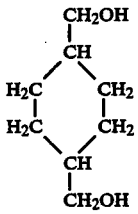
$HOCH_2-CH=CH-CH_2OH$ (54)
$CH_3CH=NOH$, (55)
$HON=CHCH=NOH$ (56)
$CH_3C(=NOH)$, (57)
|
$CH_3C=O$
$HOCH_2CH=NOH$ (58)

-continued (59)

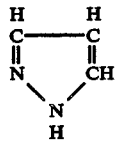

(60)

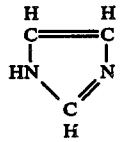

(61)

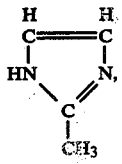

(62)

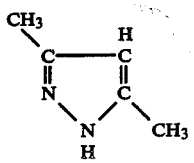

8. A dry image-forming process as claimed in claim 1, wherein said base is an inorganic base.

9. A dry image-forming process as claimed in claim 1, wherein said base is an organic base.

10. A dry image-forming process as claimed in claim 1, wherein said base has pKa of not less than 8.

11. A dry image-forming process as claimed in claim 1, wherein said dye-fixing material contains said base or said base precursor in an amount of not more than 50 wt % based on the total coating amount of the dye-fixing material.

12. A dry image-forming process as claimed in claim 1, wherein said temperature is 60° to 250° C.

13. A dry image-forming process as claimed in claim 1, wherein the dye-forming compound is selected from the group consisting of:

a dye-releasing compound capable of releasing a mobile dye by chemical reaction with the oxidation product of a reducing agent formed by a redox reaction with silver halide caused by heating;

a coupler capable of forming a mobile dye by the a coupling reaction thereof with the oxidation product of a reducing agent formed by a redox reaction with silver halide caused by heating;

a non-diffusible compound which does not originally release a dye but releases a mobile dye when it is reduced; and a compound which originally releases a mobile dye by heating becomes a compound not releasing a mobile dye by undergoing a redox reaction with silver halide by heating.

14. A dry image-forming process as claimed in claim 1, wherein the thermal solvent is present in the dye-fixing layer and/or a layer adjacent thereto.

* * * * *